US009981481B2

(12) United States Patent
Inokuchi et al.

(10) Patent No.: US 9,981,481 B2
(45) Date of Patent: May 29, 2018

(54) THERMAL TRANSFER PRINTER AND PRINTING METHOD USING SAME

(71) Applicants: CITIZEN WATCH CO., LTD., Nishitokyo-shi (JP); CITIZEN SYSTEMS JAPAN CO., LTD., Nishitokyo-shi, Tokyo (JP)

(72) Inventors: Yutaka Inokuchi, Iida (JP); Takeshi Yamazaki, Iida (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days. days.

(21) Appl. No.: 15/515,233

(22) PCT Filed: Sep. 17, 2015

(86) PCT No.: PCT/JP2015/076539
§ 371 (c)(1),
(2) Date: Mar. 29, 2017

(87) PCT Pub. No.: WO2016/052236
PCT Pub. Date: Apr. 7, 2016

(65) Prior Publication Data

US 2017/0246881 A1 Aug. 31, 2017

(30) Foreign Application Priority Data

Sep. 29, 2014 (JP) ..... 2014-199419
Sep. 29, 2014 (JP) ..... 2014-199429

(51) Int. Cl.
*B41J 2/32* (2006.01)
*B41J 2/35* (2006.01)
(Continued)

(52) U.S. Cl.
CPC . *B41J 2/36* (2013.01); *B41J 2/32* (2013.01); *B41J 2/325* (2013.01); *B41J 2/355* (2013.01); *B41J 29/46* (2013.01)

(58) Field of Classification Search
CPC ..... B41J 2/32; B41J 2/325; B41J 2/355; B41J 2/36; B41J 29/46
(Continued)

(56) References Cited

U.S. PATENT DOCUMENTS 6,023,284 A 2/2000 Rogers et al.
2011/0032380 A1 2/2011 Ishida

FOREIGN PATENT DOCUMENTS

EP 0922585 A2 6/1999
JP 59199271 A 11/1984
(Continued)

OTHER PUBLICATIONS

International Search Report with partial English language translation for International Application No. PCT/JP2015/076539, dated Dec. 1, 2015.
(Continued)

*Primary Examiner* — Huan Tran
*Assistant Examiner* — Alexander D Shenderov
(74) *Attorney, Agent, or Firm* — RatnerPrestia

(57) ABSTRACT

Irregularities in the density that can occur in printed images of a thermal transfer printer due to mechanical variations or variations in thermal characteristics in the thermal head are more easily and accurately corrected as compared to cases not having the features of the disclosed invention. The thermal transfer printer includes a thermal head including heating elements and causing the heating elements to generate heat and transfer ink onto a sheet to print an image on the sheet, a storage unit for storing a first correspondence between a heating element in the thermal head and a
(Continued)

correction amount of energy applied to the heating element and a second correspondence between a density of an image to be printed and an adjustment coefficient of the correction amount, and a control unit for correcting energy applied to each heating element by an amount obtained by multiplying the correction amount for the heating element obtained from the first correspondence by the adjustment coefficient obtained from the second correspondence according to a density of an image to be newly printed. The first correspondence is generated from a density distribution of a test image printed based on image data of a single tone.

11 Claims, 19 Drawing Sheets

(51) Int. Cl.

| | |
|---|---|
| ***B41J 2/355*** | (2006.01) |
| ***B41J 2/36*** | (2006.01) |
| *B41J 2/325* | (2006.01) |
| *B41J 29/46* | (2006.01) |

(58) Field of Classification Search
USPC ..... 347/188
See application file for complete search history.

(56) References Cited

FOREIGN PATENT DOCUMENTS

| | | | |
|---|---|---|---|
| JP | 61008365 | A | 1/1986 |
| JP | 05293996 | A | 11/1993 |
| JP | 07076115 | A | 3/1995 |
| JP | 07085238 | A | 3/1995 |
| JP | 10217527 | A | 8/1998 |
| JP | 10324016 | A | 12/1998 |
| JP | 11112809 | A | 4/1999 |
| JP | 11170589 | A | 6/1999 |
| JP | 2003334985 | A | 11/2003 |
| JP | 2006053332 | A | 2/2006 |
| JP | 2006168195 | A | 6/2006 |
| JP | 2011060270 | A | 3/2011 |

OTHER PUBLICATIONS

Written Opinion of the International Searching Authority with English language translation for International Application No. PCT/JP2015/076539, dated Jan. 12, 2015, 10 pages.

Notification of Reasons for Refusal for Japanese Application No. 2014199419, dated Mar. 13, 2018, including English translation, 7 pages.

Notification of Reasons for Refusal for Japanese Application No. 2014199429, dated Mar. 13, 2018, including English translation, 7 pages.

THERMAL TRANSFER PRINTER AND PRINTING METHOD USING SAME

CROSS REFERENCE TO RELATED APPLICATIONS

This is the U.S. National Phase application of PCT/JP2015/076539, filed Sep. 17, 2015, which claims priority to Japanese Patent Application No. 2014-199419, filed Sep. 29, 2014, and Japanese Patent Application No. 2014-199429, filed Sep. 29, 2014, the disclosures of each of these applications being incorporated herein by reference in their entireties for all purposes.

TECHNICAL FIELD

The present invention relates to a thermal transfer printer and a print method using the same.

BACKGROUND ART

A thermal transfer printer uses a thermal head arranged with as many heating elements (heat generating resistors) as a number corresponding to the number of pixels in one line in the main scanning direction, and causes the heating elements to generate heat in accordance with image data to print an image by thermally transferring ink onto a sheet. This thermal head involves variations in thermal characteristics (a heat generation amount, a heat storage amount, a heat dissipation property, and the like) and mechanical variations (tolerance) such as the height of the glaze, a curvature of the convex portion, and the like, in the direction in which the heating elements are arranged (main scanning direction). For this reason, the thermal transfer printer may print an image having irregularities in the density even if the thermal transfer printer prints the image based on image data having the same tone.

Therefore, various techniques have been suggested to correct the irregularities in the density, for example, by printing a test image having uniform tone, scanning the image to detect the density of the printed image, and adjusting the energization time and the like of each of the heating elements according to the detected density (for example, see Patent Literature 1, 2). Further, in order to improve the accuracy of correction, a technique have been suggested to correct the irregularities in the density based on a measurement result of the density of a printed matter having a belt-like pattern of two tones or more (for example, see Patent Literature 3).

CITATION LIST

Patent Literature

Patent Literature 1: Japanese Laid-open Patent Publication No. S61-008365

Patent Literature 2: Japanese Laid-open Patent Publication No. H5-293996

Patent Literature 3: Japanese Patent No. 3703061

SUMMARY OF INVENTION

However, when irregularities in the density are corrected by using a test image having belt-like patterns with a plurality of tones, it is necessary to measure the densities at a plurality of points in order to create correction data, which makes the correction work complicated and requires many man-hours. Further, in many cases, transported sheets may meander, and if such meandering occurs when printing a test image, this generates a change in the positional relationship between the heating elements of the thermal head and the irregularities in the density of the printed matter. This may make it impossible to properly correct the irregularities in the density, and in addition, this may adversely affect the irregularities in the density as a result of correction.

Therefore, it is an object of the present invention to more easily and accurately correct irregularities in the density that can occur in printed images of a thermal transfer printer due to mechanical variations or variations in thermal characteristics in the thermal head, as compared to cases not having the features of the disclosed invention. In addition, it is another object of the present invention to improve the accuracy of correction by excluding the adverse effect of sheet meandering and variations of the pitches between heating elements of the thermal head when correcting the irregularities in the density that can occur in printed images of the thermal transfer printer due to thermal and mechanical variations in the width direction of the thermal head.

Provided is a thermal transfer printer including a thermal head including a plurality of heating elements and causing the heating elements to generate heat and transfer ink onto a sheet to print an image on the sheet, a storage unit for storing a first correspondence between a heating element in the thermal head and a correction amount of energy applied to the heating element and a second correspondence between a density of an image to be printed and an adjustment coefficient of the correction amount, and a control unit for correcting energy applied to each of the heating elements by an amount obtained by multiplying the correction amount for the heating element obtained from the first correspondence by the adjustment coefficient obtained from the second correspondence according to a density of an image to be newly printed. The first correspondence is generated from a density distribution of a test image printed based on image data of a single tone.

Preferably, in the above thermal transfer printer, the storage unit is a non-volatile memory attached to the thermal head.

Preferably, in the above thermal transfer printer, the storage unit further stores information about a reference density of printing with the thermal head, and the control unit corrects the energy by an amount obtained by multiplying the correction amount for the heating element obtained from the information about the reference density and the first correspondence by the adjustment coefficient according to a density of an image to be newly printed, the correction amount being required to cause a density of printing with each heating element to match the reference density.

In the case where the above thermal transfer printer is capable of switching between a plurality of print speeds, it is preferable that the thermal head can print an image at one of a plurality of print speeds, the storage unit store the first correspondence and the second correspondence for each of the print speeds, and the control unit correct the energy by referring to the first correspondence and the second correspondence according to a print speed of the thermal head.

Provided is a method of printing an image using a thermal transfer printer, including the steps of generating a first correspondence between each of a plurality of heating elements in a thermal head and a correction amount of energy applied to the heating element from a density distribution of a test image printed based on image data of a single tone, correcting energy applied to each of the heating elements by an amount obtained by multiplying the correction amount for the heating element obtained from the first correspondence by an adjustment coefficient obtained from a second correspondence between a density of an image to be printed and the adjustment coefficient of the correction amount according to a density of an image to be newly printed, and transferring ink onto a sheet by causing the plurality of heating elements to generate heat with the corrected energy.

Preferably, the step of generating of the above method includes the steps of printing the test image with the thermal head, scanning the printed test image, calculating an average density distribution on the scanned test image, and determining the correction amount for each of the plurality of heating elements on the basis of the average density distribution.

Provided is a method for manufacturing a thermal head of a thermal transfer printer, including the steps of printing, based on image data of a single tone, a test image including a plurality of makers indicating positions of a plurality of heating elements in a thermal head in which the heating elements are arranged in a main scanning direction of printing, scanning the printed test image, identifying positions corresponding to the plurality of heating elements in the main scanning direction on the scanned test image from positions of the plurality of markers included in the scanned test image, calculating an average density distribution on the scanned test image, and storing correction data of energy applied to each of the heating elements in a non-volatile memory attached to the thermal head, the correction data being obtained based on the average density distribution.

Preferably, the above method further includes the step of enlarging or reducing the scanned test image for each of partial areas in the main scanning direction so that the positions of the plurality of markers included in the scanned test image match positions calculated from resolution of printing, and in the step of calculating, the average density distribution on the enlarged or reduced test image is calculated.

Preferably, in the step of calculating of the above method, the average density distribution is calculated by deriving an average density of the scanned test image in a sub-scanning direction of printing for a position corresponding to each of the heating elements arranged in a main scanning direction of printing and further deriving a moving average of the average density in the main scanning direction.

The thermal transfer printer may be a color printer which sequentially transfers inks of a plurality of colors to obtain a color output. In this case, preferably, in the step of printing of the above method, inks of a plurality of colors are sequentially transferred onto a sheet, and thereby a test image generated so as to have a mixed color of the inks of all the colors is printed on the sheet, in the step of scanning, the printed test image is scanned as a color image, and in the step of calculating, the average density distribution is calculated by deriving a density distribution of the scanned test image of each component of RGB of the color image and further averaging a waveform of the density distribution of each component by reducing a weighting for a variation portion appearing only in one of the RGB colors in the waveform of the density distribution of the component thus derived.

Preferably, in the step of storing of the above method, correction amount of energy applied to each of the heating elements obtained based on the average density distribution, and an adjustment coefficient of the correction amount according to a density of an image to be newly printed are stored as the correction data.

Preferably, in the step of storing of the above method, information about a reference density of printing with the thermal head is further stored as the correction data.

Preferably, in the step of calculating of the above method, the average density distribution of an area of the scanned test image excluding a predetermined range corresponding to an end portion of the printed test image is calculated.

The above thermal transfer printer and print method can more easily and accurately correct irregularities in the density that can occur in printed images of a thermal transfer printer due to mechanical variations or variations in thermal characteristics in the thermal head, as compared to cases not having the features of the disclosed invention. In addition, the above manufacturing method can improve the accuracy of correction by excluding the adverse effect of sheet meandering and variations of the pitches between heating elements of the thermal head when correcting the irregularities in the density that can occur in printed images of the thermal transfer printer due to thermal and mechanical variations in the width direction of the thermal head.

DESCRIPTION OF EMBODIMENTS

Hereinafter, with reference to the accompanying drawings, a thermal transfer printer, a print method using the same, and a method for manufacturing a thermal head of a thermal transfer printer will be explained in detail. However, it should be noted that the present invention is not limited to the drawings or the embodiments described below.

Figure 1:
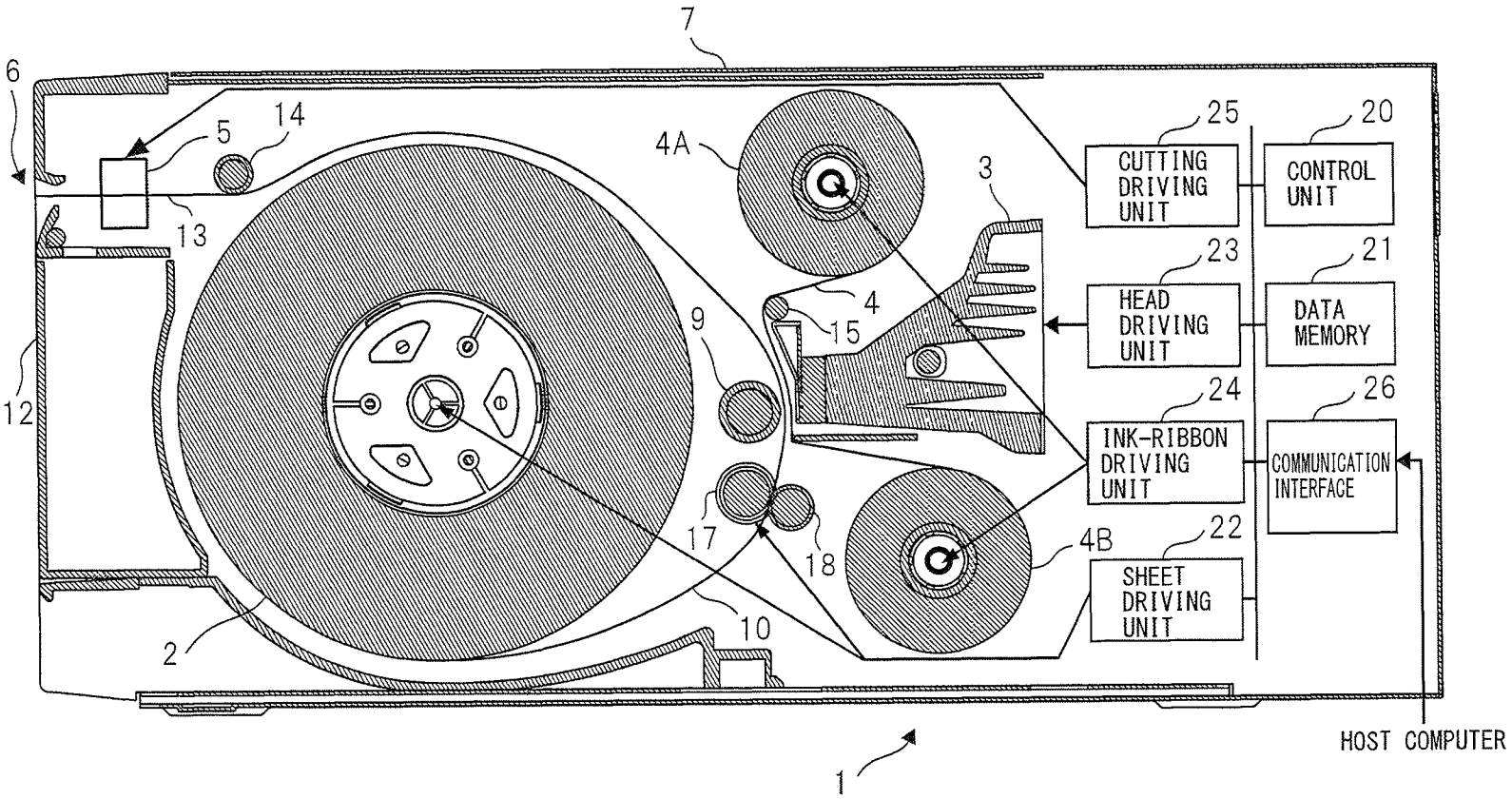
FIG. 1 is a cross-sectional view illustrating a schematic configuration of a printer 1.

FIG. 1 is a cross-sectional view illustrating a schematic configuration of a printer 1. FIG. 1 illustrates only some of the constituent elements of the printer 1 which are required for explanation, and the other constituent elements are omitted.

As main constituent elements, the printer 1 includes a roll paper holder 2, a head 3, a supply-side ribbon roller 4A, a winding-side ribbon roller 4B, a cutting unit 5, a platen roller 9, a discharge roller 14, a ribbon guide roller 15, a grip roller 17, a pinch roller 18, and the like. Each of these constituent elements is arranged in a housing 7. The printer 1 also includes a control unit 20, a data memory 21, a sheet driving unit 22, a head driving unit 23, an ink-ribbon driving unit 24, a cutting driving unit 25, and a communication interface 26.

The printer 1 is a thermal transfer printer which transfers ink applied to the ink ribbon 4 onto a sheet 10 in a roll form to print an image thereon. The printer 1 reciprocally moves the sheet 10 with respect to the head 3 to sequentially transfer a plurality of colors, e.g., yellow, magenta, and cyan and an overcoat onto the same area of the sheet 10 from the ink ribbon 4. The printed sheet 10 is cut by the cutting unit 5 and discharged from a discharge slot 6 provided on a front face 12 of the printer 1 to the outside of the printer 1. In the following explanation, printing an image may also be referred to as "image printing".

The roll paper holder 2 holds the sheet 10 wound in a roll. The material of the sheet 10 is not particularly limited as long as it can be used for a thermal transfer printer. The roll paper holder 2 is driven in forward or backward direction by the sheet driving unit 22 and rotates around its central axis. When the roll paper holder 2 rotates in the forward direction, the sheet 10 passes between the head 3 and the platen roller 9 and is transported toward the discharge slot 6. When the roll paper holder 2 rotates in the backward direction, the sheet 10 is wound back into the roll paper holder 2.

The supply-side ribbon roller 4A and the winding-side ribbon roller 4B hold the ink ribbon 4. These rollers are driven by the ink-ribbon driving unit 24 and rotate around their central axes. With this driving, the ink ribbon 4 is supplied from the supply-side ribbon roller 4A, passes between the head 3 and the platen roller 9 via the ribbon guide roller 15, and is wound by the winding-side ribbon roller 4B.

The ink ribbon 4 is a belt-like sheet in which ink regions, e.g., yellow, magenta, and cyan and a region of the overcoat are repeatedly arranged in the same order in the longitudinal direction. However, the ink ribbon 4 is not limited to such a sheet including inks of a plurality of colors, and may be a sheet including only an ink of a single color.

The head 3 is configured to be movable with respect to the platen roller 9 and is pressed against the platen roller 9 with the ink ribbon 4 and the sheet 10 sandwiched therebetween during image printing. The head 3 causes a plurality of built-in heating elements to generate heat and prints an image on the sheet by sequentially transferring each color ink and the overcoat on the ink ribbon 4 onto the same area of the sheet 10. This transfer is repeated for each region of the ink ribbon 4 while winding the ink ribbon 4. A mechanism according to the type of the thermal transfer printer such as, for example, sublimation type and heat melting type is used for the head 3.

Figure 2:
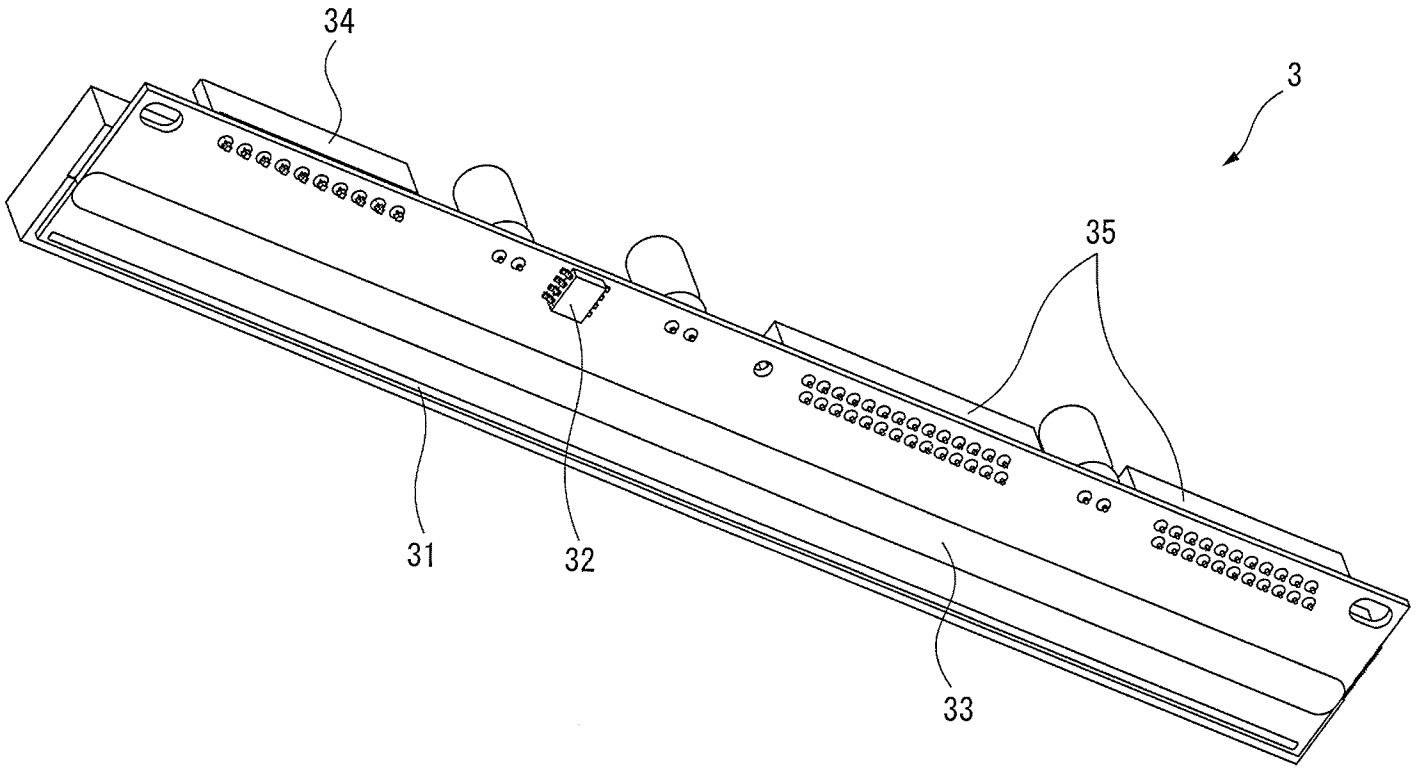
FIG. 2 is a perspective view illustrating the head 3.

FIG. 2 is a perspective view illustrating the head 3. The head 3 is also referred to as a thermal head, and includes a printing unit (glazes, heating elements) 31, a storage unit 32, a mold 33, a power connector 34, and a logic connector 35.

The printing unit 31 is formed by arranging as many heating elements as the number of pixels in the main scanning direction. Each heating element generates heat by being energized by the head driving unit 23 according to image data, and transfers the ink of the ink ribbon 4 onto the sheet 10 with the heat. Hereinafter, each heating element constituting the printing unit 31 will be referred to as a "heating element 31".

The storage unit 32 is an electrically rewritable non-volatile memory (EEPROM) storing correction data, which will be described later, for correcting irregularities in the density caused by the head 3. The mold 33 is a frame body for protecting driver ICs and wirings (not illustrated) built in the head 3. The power connector 34 is a terminal for connecting each heating element 31 to a power source (not illustrated). The logic connector 35 is a terminal for connecting the head 3 to the control unit 20 and controlling the operation of the head 3.

Referring back to FIG. 1, the grip roller 17 and the pinch roller 18 transport the sheet 10 while sandwiching the sheet 10. The grip roller 17 is driven by the sheet driving unit 22 to rotate either in the direction of feeding the sheet 10 (forward direction) or in the direction of rewinding (backward direction). The pinch roller 18 rotates by being driven by the grip roller 17. When transporting the sheet 10, the pinch roller 18 comes into contact with the grip roller 17 to hold the sheet 10 with the grip roller 17. In times other than transporting the sheet 10, the pinch roller 18 is separated from the grip roller 17 to release the sheet 10.

The sheet 10 which is fed from the roll paper holder 2 and has passed between the head 3 and the platen roller 9 is transported through a discharge path 13 to the discharge slot 6 by the discharge roller 14. The cutting unit 5 cuts, at the position before the discharge slot 6, the sheet 10 which has passed through the discharge path 13 and has been discharged from the discharge slot 6 to the outside of the printer 1. The cutting unit 5 is located just before the discharge slot 6 on the discharge path 13 and is driven by the cutting driving unit 25.

The control unit 20 is constituted by a microcomputer including a CPU, a memory, and the like, and controls the overall operation of the printer 1. The data memory 21 is a storage area for storing image data received from a host computer via the communication interface 26. The sheet driving unit 22 is a motor that drives the grip roller 17 and the roll paper holder 2, and rotates them in a direction for feeding the sheet 10 or in a direction for rewinding the sheet 10. The head driving unit 23 drives the head 3 on the basis of the image data and causes an image to be printed on the sheet 10. The ink-ribbon driving unit 24 is a motor that drives the supply-side ribbon roller 4A and the winding-side ribbon roller 4B, and rotates the supply-side ribbon roller 4A and the winding-side ribbon roller 4B in a direction in which the winding-side ribbon roller 4B winds the ink ribbon 4 or in a direction in which the supply-side ribbon roller 4A rewinds the ink ribbon 4. The cutting driving unit 25 is a motor that drives the cutting unit 5. The communication interface 26 receives image data, which is to be printed, from the host computer via, for example, a communication cable.

Hereinafter, the correction of irregularities in the density of the printer 1 will be explained. Since there is a correlation between the proper correction amount of irregularities in the density and the density of the printed image, the printer 1 uses this fact in order to correct the irregularities in the density. For the printer 1, the density of a test image printed based on image data of a single tone is measured, and, from the density distribution, a "correction table" is generated which represents a correspondence between each heating element 31 in the head 3 and a correction amount of the energy applied to the heating element 31 according to the coloring characteristics of the head 3 at the position of the heating element 31. Then, the printer 1 uses the correction table and a "correction-amount adjustment table" that defines to what degree the density correction based on the correction table is taken into effect depending on the density of the image to be printed, so that the printer 1 calculates the correction amount of the energy applied to each heating element 31 from information about the average printing density of the head 3 and the density of the image to be printed. The correction table is an example of first correspondence, and the correction-amount adjustment table is an example of second correspondence. The printer 1 prints an image by driving the head 3 with applying the corrected energy, thus preventing an occurrence of density differences (irregularities in the density unique to the head) on printed images, which may occur due to a difference in thermal characteristics, a difference in mechanical shapes, and the like of the thermal head.

Figure 3:
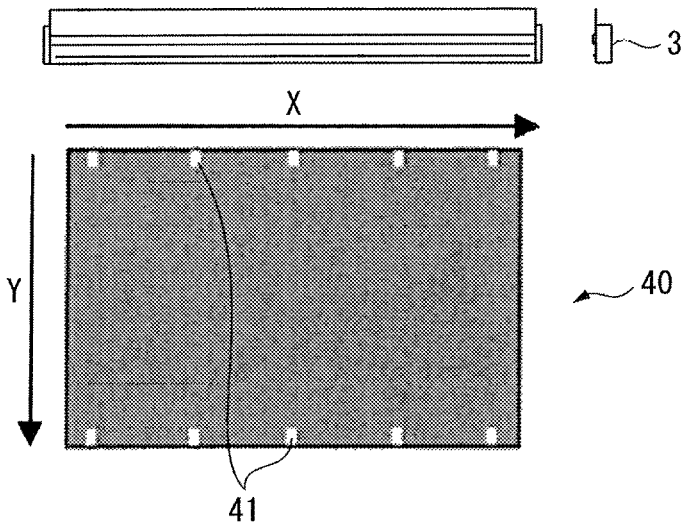
FIG. 3 illustrates an example of the test image.

FIG. 3 illustrates an example of the test image. The test image 40 illustrated in FIG. 3 is a gray image of a single tone. For the printer 1, the correction table is generated by using such a test image 40 of a single tone. Therefore, for the printer 1, it is not necessary to measure the density of the belt-like pattern of a plurality of tones, and it is enough to measure only a single tone, so that the correction work of irregularities in the density is simplified.

In FIG. 3, the main scanning direction of printing with the head 3 is indicated as X direction, and the sub-scanning direction thereof is indicated as Y direction. The main scanning direction is the direction in which the heating elements 31 of the head 3 are arranged, and the sub-scanning direction is the printing direction of the printer 1. The test image 40 includes a plurality of elongated white markers 41 at both ends of the sub-scanning direction. FIG. 3 illustrates an example where there are five markers 41 at each end. With the printer 1, the markers 41 are provided on the test image 40 by particular heating elements 31 in the head 3. Each marker 41 indicates a correspondence between the position of the X direction on the test image 40 and the position of the heating element 31 in the head 3. Since the heating elements 31 are provided with a narrow pitch corresponding to the number of pixels, one marker 41 actually corresponds to a plurality of adjacent heating elements 31. Even if the sheet meanders at the time of printing of the test image 40 or at the time of reading (scanning) for measuring the density thereof, the markers 41 enable finding the positional relationship between the heating elements 31 in the head 3 and the irregularities in the density on the image. Depending on the tolerance of the head 3, there may be variations in the positions of the heating elements 31 in the main scanning direction (X direction). However, when the markers 41 are used, the position of each heating element 31 can be identified even if such variations occur. Therefore, the irregularities in the density can be corrected properly.

Figure 4:
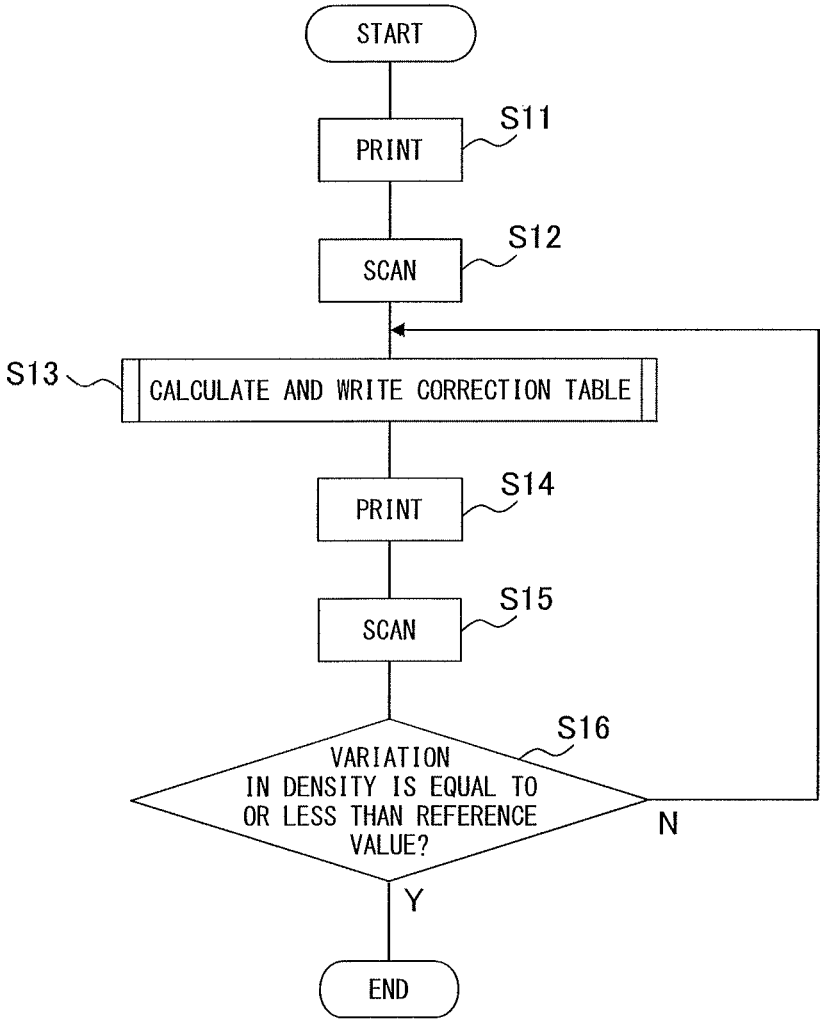
FIG. 4 is a flowchart illustrating an example of processing for creating correction data for irregularities in the density.
Figure 5:
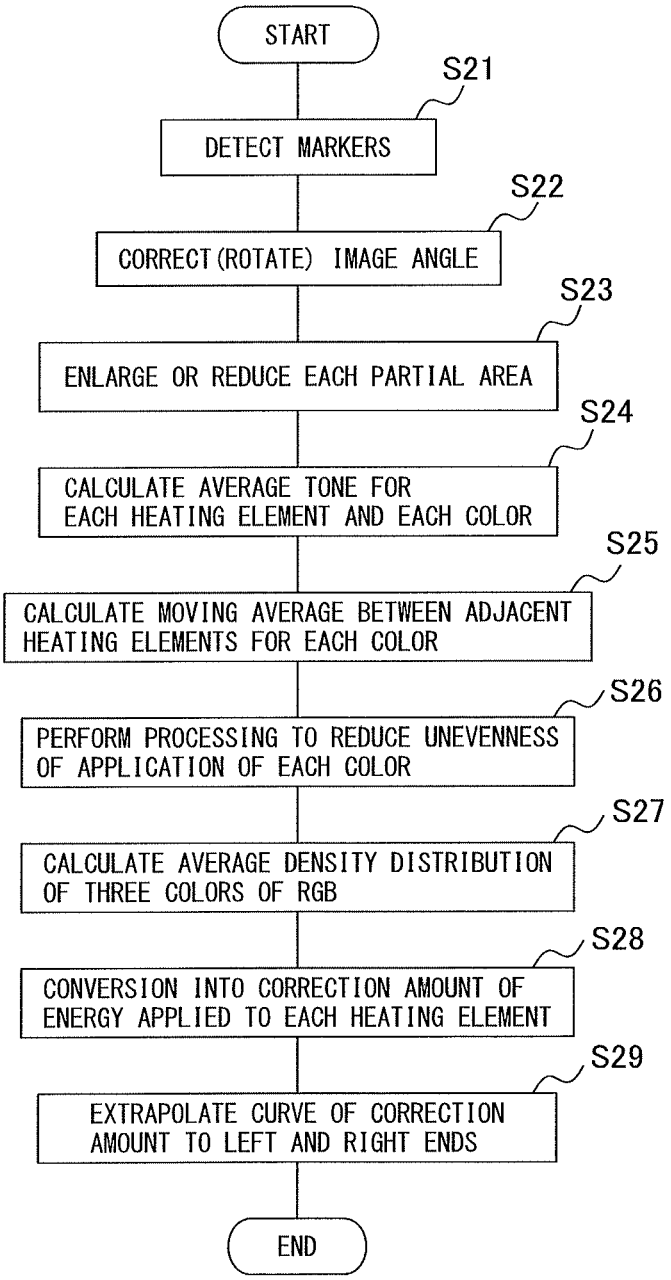
FIG. 5 is a flowchart illustrating an example of processing for creating correction data for irregularities in the density.

FIG. 4 and FIG. 5 are flowcharts illustrating an example of processing for creating correction data for irregularities in the density. FIG. 4 illustrates the overall flow, and FIG. 5 illustrates the detailed flow of processing for generating the correction table in step S13 of FIG. 4. FIG. 6 to FIG. 19 are diagrams for explaining the processing for generating the correction table. The flows illustrated in FIG. 4 and FIG. 5 are executed by a PC or the like (not illustrated), and the measurement data of the density distribution of the test image 40 printed by the printer 1 is processed by a PC or the like.

First, the overall flow will be explained with reference to FIG. 4. First, the test image 40 illustrated in FIG. 3 is printed by the printer 1 (step S11). Then, the printed test image 40 is read by a scanner (not illustrated) (step S12), and the read image data is input into a PC. When the printer to be corrected is a color printer, it is preferable to scan the test image 40 as a color image. Subsequently, the correction table is calculated by the PC and written in the storage unit 32 of the head 3 (step S13). In step S13, the information about the average printing density of the head 3 is also calculated and written in the storage unit 32. The average printing density is calculated as difference information between the density characteristic of a reference head (information about a reference density of the print) and the density characteristic of the head to be adjusted. The average printing density may be obtained from tone values of the scanned image of the test image. However, it is possible to perform more accurate correction by printing a dedicated test image under the condition that the correction according to the calculated correction table is performed and obtaining an average printing density with a dedicated colorimeter (spectral density meter and the like).

Then, under the correction made with this correction table, the test image 40 is printed again by the printer 1 (step S14), and read by the scanner (step S15). The read image data is input into the PC, and the PC determines whether a variation in the density distribution of the test image 40 printed in step S14 (the irregularities in the density) is equal to or less than a predetermined reference value (step S16). At this occasion, for example, the density ratio between a pixel having the lowest density and a pixel having the highest density is compared with the reference value. When the variation in the density distribution is more than the reference value (No in step S16), the process returns to step S13 to calculate the correction table again. On the other hand, when the variation of the density distribution is equal to or less than the reference value (Yes in step S16), processing for generating correction data is completed. In step S16, it is preferable to also determine the adequacy of the average printing density, and to modify this information as necessary. The adequacy of the average printing density can be determined by, for example, printing a dedicated test image, measuring the printed test image with a dedicated colorimeter, and comparing it with the printing density of a head serving as the reference.

Subsequently, with reference to FIG. 5, the detailed flow of the processing for generating the correction table in step S13 of FIG. 4 will be explained. First, the positions of the markers 41 in the input image are detected (step S21). The positions corresponding to the heating elements in the main scanning direction on the image are identified from the positions of the markers 41 included in the scanned image.

Figure 6:
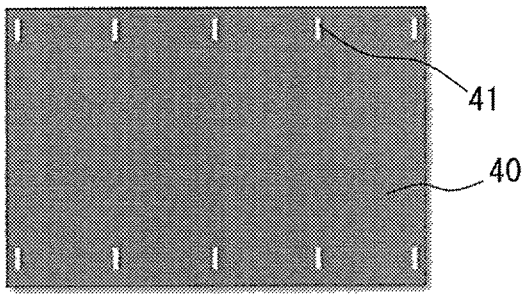
FIG. 6 illustrates an example of the test image 40.
Figure 7:
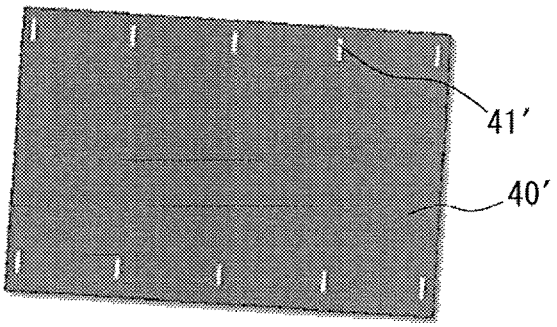
FIG. 7 illustrates an example of the test image 40' obtained by scanning.

FIG. 6 illustrates an example of the test image 40, and FIG. 7 illustrates an example of the test image 40' obtained by scanning. Reference symbol 41' denotes a detected marker. FIG. 7 illustrates an example where the test image 40' is inclined. Due to the meandering of the sheet, the test image 40 may be printed obliquely on the sheet, or the test image 40' may be skewed when the test image 40' is read by the scanner.

Figure 8:
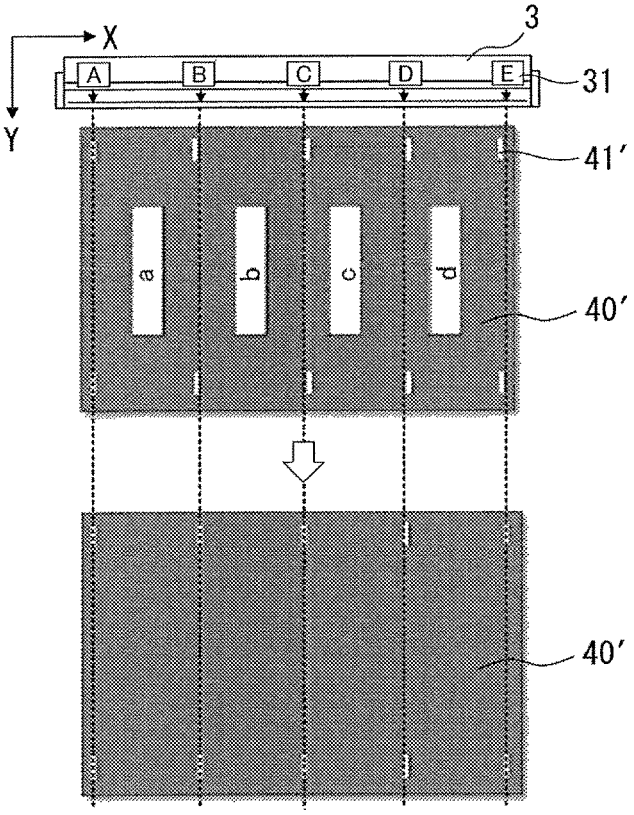
FIG. 8 is a diagram for explaining enlargement or reduction of each partial area of the test image 40'.

The magnitude of the inclination of the test image 40' can be found from the positions of the detected markers 41'. Therefore, when there is an inclination of the test image 40', the angle of the test image 40' is corrected by known image rotation processing (step S22). FIG. 8 illustrates the test image 40' of which inclination has been corrected.

Subsequently, the scanned image is enlarged or reduced for each partial area in the main scanning direction so that the positions of the markers included in the scanned image match the positions calculated from the resolution of printing (step S23). FIG. 8 also illustrates the positions A to E of five heating elements 31 which are some of the heating elements 31 of head 3 and which print the markers 41. The broken lines in FIG. 8 illustrate theoretical positions of the markers 41 in the main scanning direction calculated from the resolution of the head 3. However, since there are variations of the pitches between the heating elements 31, the positions of the markers 41' on the actually scanned test image 40' may be different from the theoretical positions of the markers 41 as illustrated in the upper side of FIG. 8. Therefore, the test image 40' is cut in the sub-scanning direction (Y direction) into four partial areas a to d by using the positions of, the markers 41' in the main scanning direction (X direction) as the reference, and each partial area is enlarged or reduced in the main scanning direction and combined again, so that the adverse effect caused by the variations of the pitches between the heating elements 31 can be corrected. The lower side of FIG. 8 illustrates a test image 40' obtained by enlarging or reducing each partial area and correcting the variations of the pitches between the heating elements 31.

For example, when the correction data for the head 3 is generated by adopting a marker at the left end of the test image as the reference, there occurs, at the right end of the test image, a difference between the print position and the read position of the scanned image as a result of an integration of the variations of the pitches between the heating elements. When the pitches are constant in any given head, it is sufficient to enlarge or reduce the entire test image 40' even if the pitch is different from the theoretical value, but when the pitches are different in the same head, it is impossible to cancel the variations of pitches by just enlarging or reducing the entire test image 40'. However, when the number of markers serving as the reference is increased to n (>1) and the partial areas are enlarged or reduced as described above, the integrated amount of shifts can be reduced to 1/n. Therefore, it is possible to more accurately correct the density distribution in the head 3 by dividing the test image 40' into a plurality of partial areas based on the plurality of markers 41', and enlarging or reducing each partial area.

Figure 9:
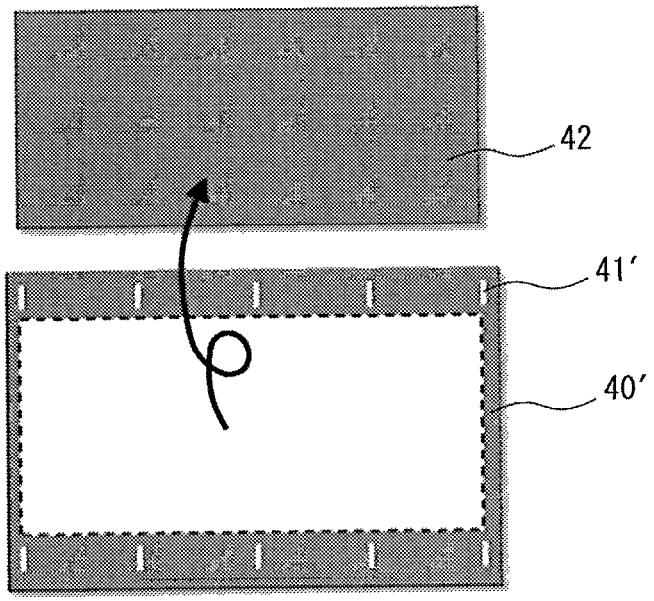
FIG. 9 illustrates a center portion 42 of the test image 40'.
Figure 10:
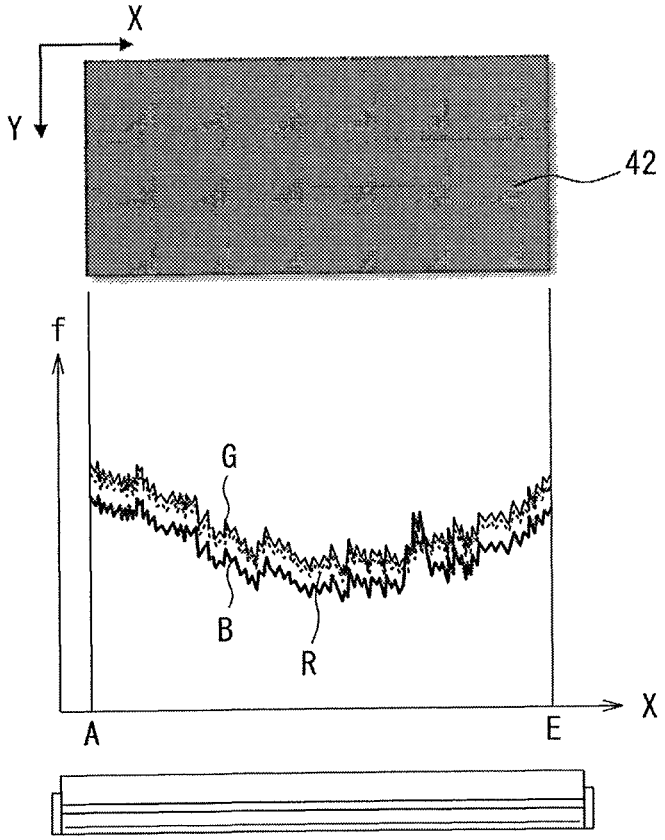
FIG. 10 illustrates an example of the distribution in the main scanning direction of the average tone value for each of the RGB colors.

Subsequently, as illustrated in FIG. 9, a center portion 42 of the test image 40' is cropped out of the test image 40' by excluding the outer peripheral portion where the markers 41' are present, and the average tone value for each heating element is calculated for the center portion 42 (step S24). At this occasion, for each of the colors of R (red), G (green), B (blue), the average value of the tones of the pixels in the sub-scanning direction (Y direction) is calculated at each of the positions corresponding to the heating elements arranged in the main scanning direction (X direction). FIG. 10 illustrates an example of the distribution in the main scanning direction (X direction) of the average tone value f for each of the RGB colors thus calculated. In each of the graphs in FIG. 11 and subsequent drawings, the horizontal axis X represents the position in the main scanning direction.

Figure 11:
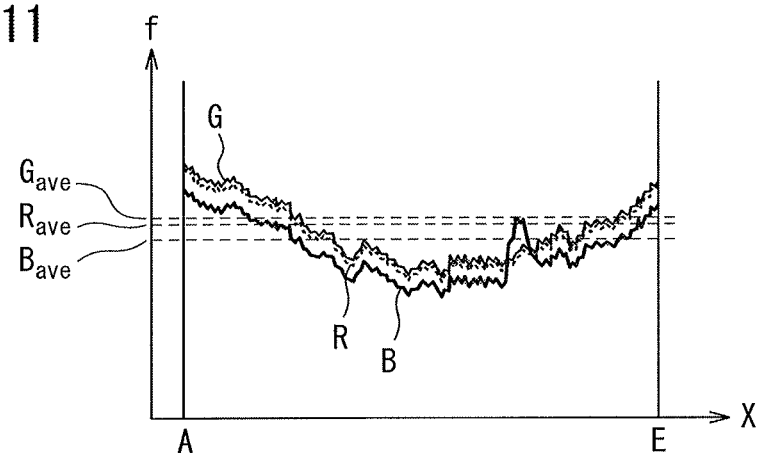
FIG. 11 illustrates, for each color, a result of calculation of a moving average of the average tone values in FIG. 10.

Further, for each of the RGB colors, a moving average in the main scanning direction of each average tone value in the sub-scanning direction is calculated (step S25). More specifically, a moving average of the average tone values for a plurality of adjacent heating elements is calculated. FIG. 11 illustrates, for each color and at each position in the main scanning direction, a result of calculation of a moving average of the average tone values f in FIG. 10 for a total of 20 heating elements which includes 10 heating elements before the position and another 10 heating elements after the position. The moving average derived in this manner can alleviate the adverse effect of dust adhered at the time of printing or scanning, and the adverse effect of slight deviation between the positions of the heating elements and the scanning position. When the number of heating elements for which the moving average is derived is too small, the moving average is susceptible to the adverse effect of dust and a shift in the scanning position. When the number of heating elements for which the moving average is derived is too large, the moving average will not be able to correct irregularities in the density if they are concentrated in a small area. For these reasons, it is effective to derive a moving average for about 3 to 20 heating elements on each side of the target heating element.

Together with the moving average calculation, the average value of the average tone values calculated in step S24 for all the heating elements is also calculated for each of the RGB colors. FIG. 11 also illustrates the average tone values $R_{ave}$, $G_{ave}$, $B_{ave}$ of all the heating elements calculated for each of the RGB colors.

Figure 12:
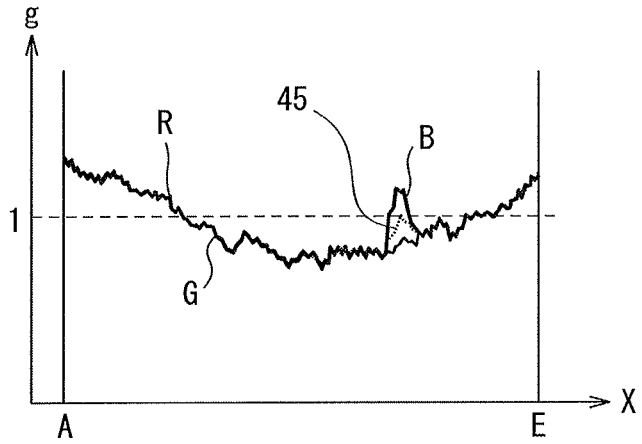
FIG. 12 illustrates the density distribution of each color obtained from the distribution of the average tone values in FIG. 11.

Subsequently, the average tone value of each of the RGB colors calculated in step S25 is divided by the average value of all the heating elements to obtain the density distribution of each color. Further, by averaging the waveforms of the obtained density distributions of the RGB colors, the waveform of the average density distribution of the three colors of RGB can also be obtained. FIG. 12 illustrates the density distribution of each color obtained from the distribution of the average tone values in FIG. 11. The vertical axis g in FIG. 12 represents the density, and "1" corresponds to the average value of the density for all the heating elements. Reference symbol 45 denotes a waveform of the average density distribution of the three colors of RGB.

Then, processing to reduce the adverse effect of unevenness of application of the ink ribbon 4 is performed on the waveform of the density distribution of each color (step S26). The variation component commonly appearing in the waveforms of the three color density distributions is irregularities in the density caused by the head 3, but the variation component appearing only in the waveform of one color is likely to be caused by a factor other than the head such as, unevenness of application of the ink ribbon 4. When correction data is generated from a test image 40 printed using an ink ribbon 4 having unevenness of application, printing with another ink ribbon 4 without any unevenness of application will create irregularities in the density in the printed image. Therefore, the variation component of the density distribution appearing only in the waveform of one color among the waveforms of the density distributions of the RGB colors is weighted so as to reduce the contribution to the correction data through the processing in step S26. An embodiment of this processing for reducing the adverse effect of unevenness of application will be described with reference to FIG. 13 to FIG. 16.

Figure 13:
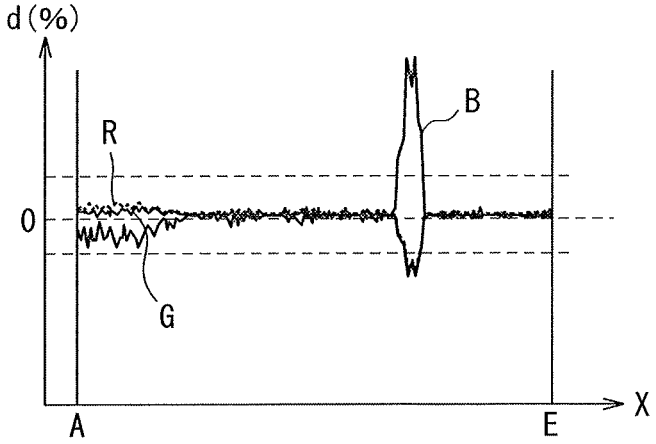
FIG. 13 illustrates the waveform of the difference between the density of each color and the average density of the three colors of RGB.
Figure 14:
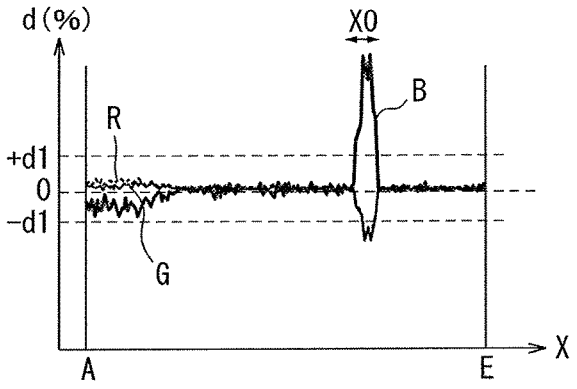
FIG. 14 illustrates the waveform of the difference between the density of each color and the average density of the three colors of RGB.

First, with respect to the position of each heating element 31 in the main scanning direction, the difference (%) between the waveform of the density distribution of each of the RGB colors and the waveform (average waveform) of the average density distribution of the three colors of RGB is obtained. FIG. 13 illustrates the waveform of the difference d between the density of each color and the average density of the three colors of RGB illustrated in FIG. 12.

Then, as to the point at which the waveform displaces to such a degree that the difference from the average waveform is more than a predetermined reference range near 0, determination is made whether or not the sign of the difference of only one of the three colors of RGB is different from the sign of the differences of the other two colors. When only the waveform of the one color displaces to the side opposite to the waveforms of the other two colors at a point where the waveform of the difference exceeds the reference range, this point is assumed to be the application-uneven portion of the ink ribbon 4. On the other hand, points where the difference waveform falls within the reference range are assumed not to be the application-uneven portion of the ink ribbon 4 regardless of the sign of the difference of each color. In the example illustrated in FIG. 14, when the range where absolute value of the difference from the average waveform is 0 to d1 is assumed to be the reference range, a portion indicated by arrow X0 is determined to be the application-uneven portion.

Figure 15:
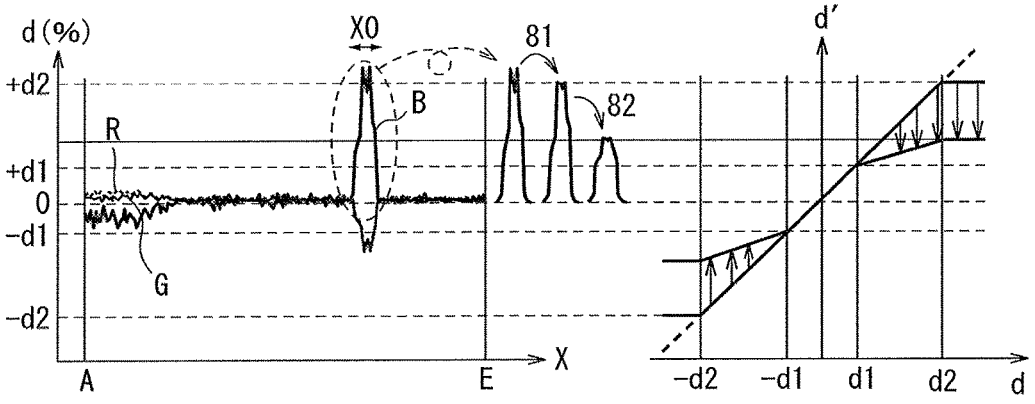
FIG. 15 is a diagram for explaining the processing for reducing the adverse effect of unevenness of application.

Correction processing is performed on the point that is determined to be the application-uneven portion, as illustrated in FIG. 15, so that the difference from the average waveform is reduced. In the correction processing, first, for a point where the absolute value of the difference exceeds d2 (where d1<d2), the absolute value is corrected to d2 (see reference symbol 81) regardless of the magnitude of the difference, and then, the portion whose absolute value of the difference exceeds d1 is compressed at a constant ratio (see reference symbol 82). The graph on the right side of FIG. 15 illustrates an example of the correction method of the difference. In the graph, the horizontal axis d represents the difference before the correction, and the vertical axis d' represents the difference after the correction.

Figure 16:
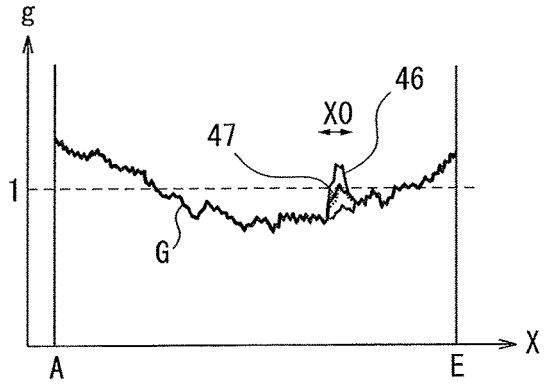
FIG. 16 illustrates the density distribution of each color before and after the processing for reducing the adverse effect of unevenness of application.

In reality, the correction processing is performed on the waveform of the density distribution of each component of the RGB, so that the difference waveform of each of the RGB colors attains the above result. For a color processed in the correction processing, the average value for all the total heating elements is calculated, and the density waveform after the correction processing is divided by the new average value, so that the waveform of the density distribution can be obtained in which the adverse effect of unevenness of application has been reduced. FIG. 16 illustrates the density distribution of each color before and after the processing (correction processing) for reducing the adverse effect of unevenness of application. The vertical axis g in FIG. 16 represents density. Reference symbol 46 denotes the density distribution of B before the correction processing, and reference symbol 47 denotes the density distribution of B after the correction processing. It is found that the density distribution of B which displaces more greatly than the density distributions of R and G in the application-uneven portion is corrected to be closer to the density distributions of R and G as a result of the correction processing.

As described above, the adverse effect of unevenness of application of the ink ribbon 4 affecting the correction data for the head 3 is suppressed, so that the ink ribbon 4 to be used is less likely to cause the irregularities in the density in an adverse manner. Further, when the correction data for the irregularities in the density is generated, a normally-managed ink ribbon 4 which is equivalent to ink ribbons sold for the general purpose can be used instead of a specially selected ink ribbon having a lower degree of unevenness of application. Therefore, it is also advantageous in view of availability (delivery time) and manufacturing cost (auxiliary material cost) of ink ribbons 4 for generating correction data.

Figure 17:
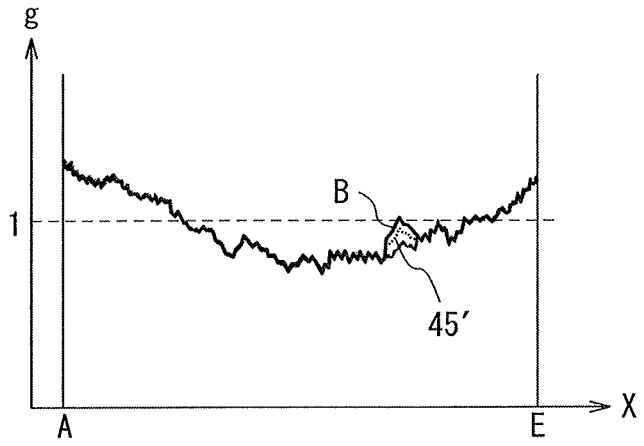
FIG. 17 illustrates the waveform of the average density distribution of the three colors of RGB after the correction processing.

Back to the flow of FIG. 5, after the processing for reducing the adverse effect of unevenness of application, the obtained waveforms, of density distributions of the RGB colors are averaged, so that the average density distribution of the three colors of RGB can be obtained in which the adverse effect of a single color component is suppressed (step S27). In the example illustrated in FIG. 13 to FIG. 16, the adverse effect of unevenness of application affecting the calculation of the density correction data is reduced by reducing, in the application-uneven portion, the weighting of B having unevenness of application. FIG. 17 illustrates the waveform 45' of the average density distribution of the three colors of RGB obtained from the waveform of the density distribution of each color after the correction processing illustrated in FIG. 16. In each of the graphs of the density distributions illustrated in FIG. 17 and the above drawings, a higher point in the vertical axis g indicates a larger tone value of RGB and a smaller tone value of YMC (yellow, magenta, and cyan), which means a lower density, and a lower point in the vertical axis g indicates a smaller tone value of RGB and a larger tone value of YMC, which means a higher density.

Figure 18:
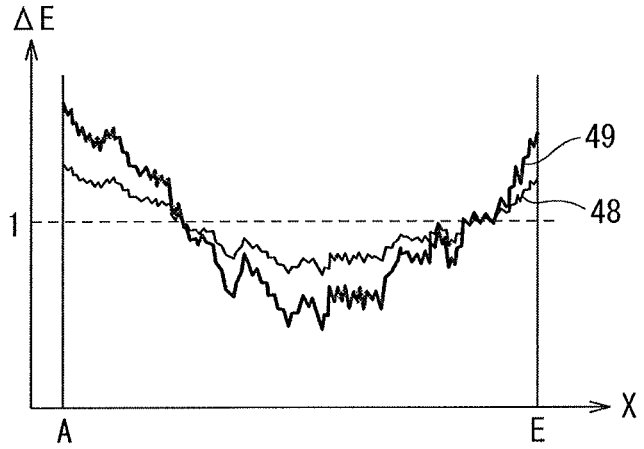
FIG. 18 illustrates the average density distribution of the three colors of RGB and a distribution of the correction amount of the applied energy.
Figure 19:
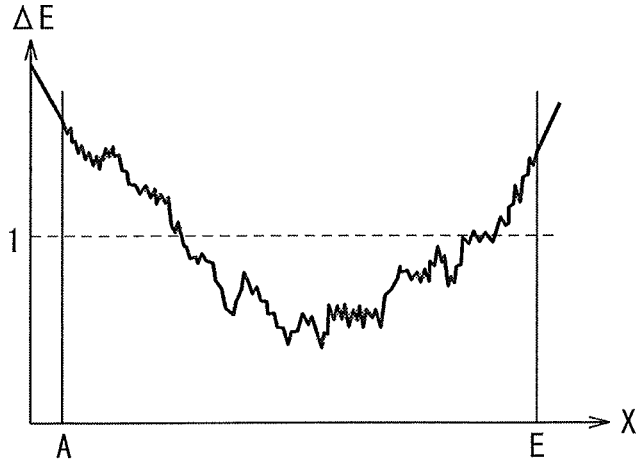
FIG. 19 illustrates a distribution of the correction amount of the applied energy, which distribution is extended in the X direction.

Then, the average density distribution obtained in step S27 is converted into the correction amount of energy applied to each heating element 31 (step S28). Since the density of the printed image is proportional to the energy applied to the head 3, this conversion is done by multiplying, by a coefficient, the average density distribution after the processing for reducing the adverse effect of unevenness of application. FIG. 18 illustrates the average density distribution 48 of the three colors of RGB illustrated in FIG. 17 and a distribution 49 of the correction amount of the applied energy obtained therefrom. In this way, the correction amount of the energy applied to each heating element 31 is obtained based on the average density distribution. In FIG. 18 and FIG. 19 subsequent thereto, a higher point in the vertical axis ΔE means a larger correction amount of the applied energy, and a lower point in the vertical axis ΔE means a smaller correction amount of the applied energy.

Finally, the distribution of the correction amount of the applied energy obtained in step S28 is extrapolated to the left and right ends in the main scanning direction (outside the center portion 42), so that the distribution of the correction amount of the energy applied to all the heating elements 31 including the left and right ends is obtained (step S29). FIG. 19 illustrates a distribution of the correction amount ΔE of the applied energy, which distribution is extended to the left side of the heating element at the position A corresponding to the marker 41 at the left end and the right side of the heating element at the position E corresponding to the marker 41 at the right end.

In general, a print result is not stable at a position close to the end portion of the sheet, and accordingly, when the measurement value of the density at the end portion of the sheet is used for generation of the correction data, this reduces the reliability of correction values. In general, in order to carry out full borderless printing, the energization width of the head 3 is wider than the sheet width of the print target, and thus it is impossible to obtain correction values of the irregularities in the density of all the heating elements only from the print result of the test image 40. Therefore, it is preferable to calculate the average density distribution of the center portion 42 of the scanned test image 40' excluding a predetermined range corresponding to the end portion of the printed test image 40, and use extrapolation to derive the correction values of the irregularities in the density for points near the end portion of the sheet.

The detailed flow of the processing illustrated in FIG. 5 for generating the correction table has been hereinabove explained. The distribution of the correction amount of the applied energy ultimately obtained in the above flow is used as the correction table of the irregularities in the density for the heating elements 31.

Figure 20:
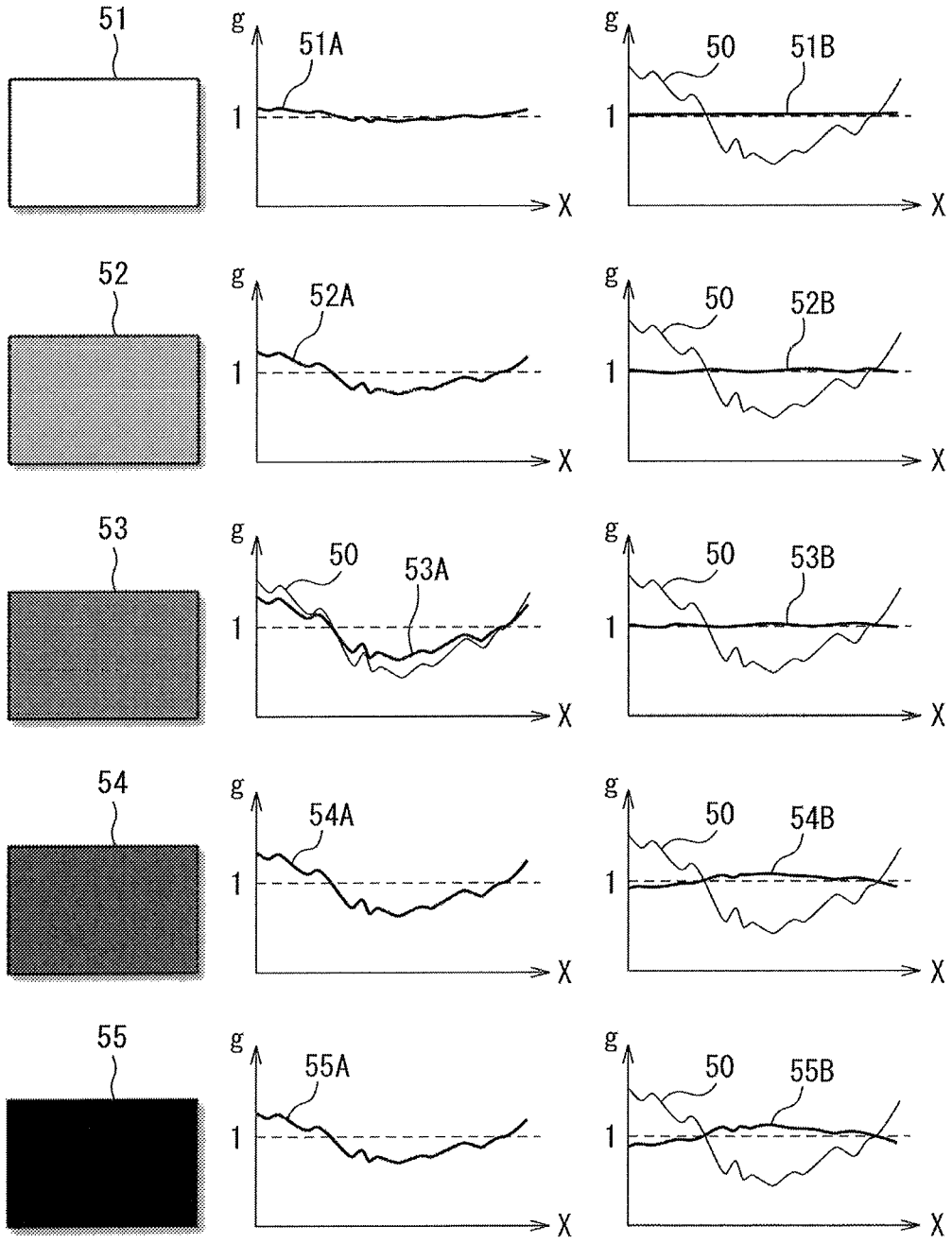
FIG. 20 is a diagram for explaining adjustment of the correction amount according to the density of an image.

FIG. 20 is a diagram for explaining adjustment of the correction amount according to the density of an image. The variation of the actual printing density for each heating element 31 varies depending on the density of the image to be printed. Therefore, when printing is performed upon correcting the applied energy based on the above correction table obtained from the density measurement result of the test image 40 of a single tone, a proper result may not be obtained depending on the density of the printed image.

Printed images 51 to 55 each having a single tone with densities different from each other are illustrated on the left side of FIG. 20. The density of the printed image 51 is the lowest, the density increases in order from the printed image 52 to the printed image 54, and the density of the printed image 55 is the highest. Further, density distributions 51A to 55A of the printed images 51 to 55 before the correction of the applied energy are illustrated in the center of FIG. 20, and density distributions 51B to 55B of the printed images 51 to 55 after the correction are illustrated on the right side of FIG. 20. Further, in each of the graphs of the density distributions 53A, 51B to 55B, a waveform 50 of the correction table is also superimposed thereon. The vertical axis g of each graph represents the density, and the horizontal axis X represents the position of each heating element 31 in the main scanning direction. As can be seen from FIG. 20, when the density of the printed image is low, the corrected density distribution almost uniformly has a value of "1" corresponding to the average value for all the heating elements, but as the density of the printed image increases, a larger difference in the density also appears in the corrected density distribution. In particular, for the printed images 54 and 55, before the correction, the density distributions 54A and 55A are low near the center of the main scanning direction and high in the vicinity of the left and right ends, but after the correction, the density distributions 54A and 55A change into the density distributions 54B and 55B which are high near the center of the main scanning direction and low in the vicinity of the left and right ends. This indicates that the correction based on the above correction table produces too much effect when the density of the printed image is high.

Figure 21:
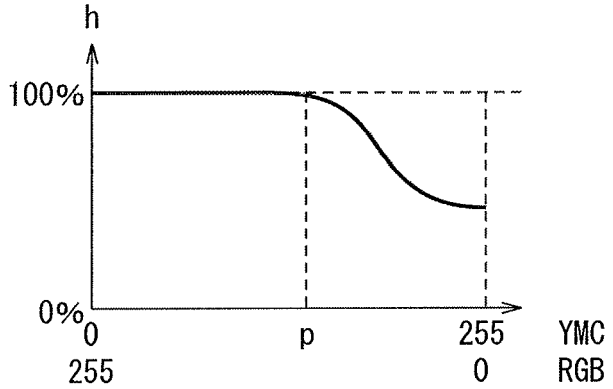
FIG. 21 illustrates an example of the correction-amount adjustment table.

FIG. 21 illustrates an example of the correction-amount adjustment table. As explained with reference to FIG. 20, there is a characteristic that, when the density of the printed image is lower, the correction of the density is less likely to be applied, and when the density of the printed image is higher, the correction of the density is more likely to be applied. Therefore, in order to properly correct the irregularities in the density regardless of the printing density, the printer 1 is provided with a correction-amount adjustment table that determines how much the correction amount obtained from the above correction table is made to be effective according to the printing density. The horizontal axis in FIG. 21 represents a tone value, and the vertical axis h represents a correction ratio (adjustment coefficient) for each image density. In FIG. 21, the tone values of RGB and those of Y (yellow), M (magenta) and C (cyan) are shown together. In the tone value of RGB, 255 corresponds to a low density, and 0 corresponds to a high density. In the tone value of YMC, 0 corresponds to a low density, and 255 corresponds to a high density.

According to this correction-amount adjustment table, when the printing density is lower than a tone value p serving as the reference, the correction amount based on the correction table is made to be effective 100, but when the printing density is higher than the tone value p, the rate by which the correction amount based on the correction table is made to be effective is reduced as the printing density is higher. When the printing density is the maximum, the rate by which the correction amount based on the correction table is made to be effective is reduced to, for example, about 50%. In the printer 1, the correction amount of the applied energy is adjusted with the correction rate obtained by referring to the correction-amount adjustment table according to the density of the image to be newly printed. Therefore, even with the correction table obtained from the density measurement result of the test image 40 of a single tone, the density distribution can be properly corrected for all the tone values regardless of the density of the printed image.

Figure 22:
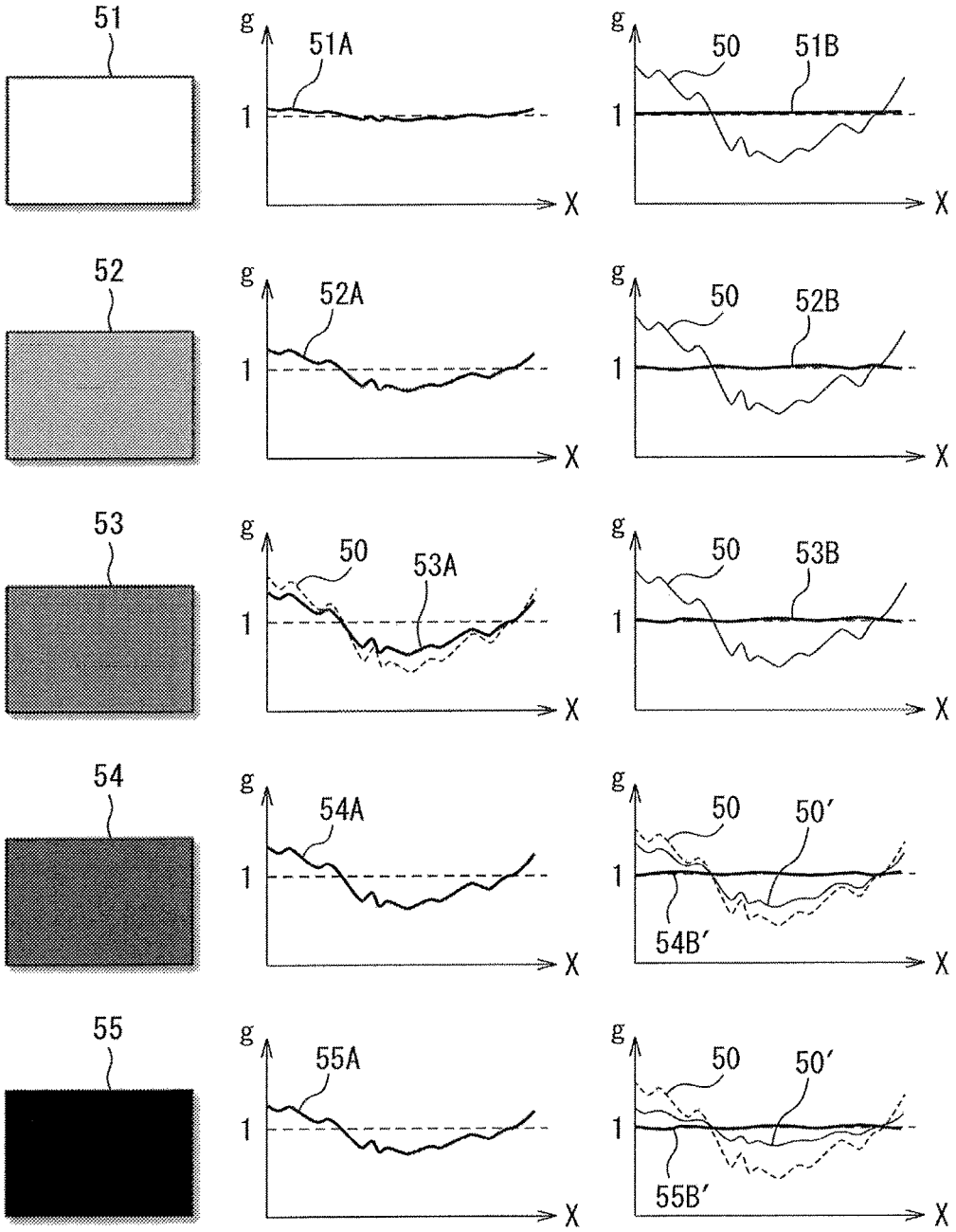
FIG. 22 illustrates an example of adjustment of the correction amount using the correction-amount adjustment table.

FIG. 22 illustrates an example of adjustment of the correction amount using the correction-amount adjustment table. Like FIG. 20, FIG. 22 illustrates printed images 51 to 55 each having a single tone with densities different from each other, density distributions 51A to 55A of the printed images 51 to 55 before the correction of the applied energy, and density distributions 51B to 53B, 54B', and 55B' of the printed images 51 to 55 after the correction. The tone value p at which the correction rate begins to decrease described in regard to FIG. 21 is assumed to correspond to the density between the printed image 53 and the printed image 54.

In this case, for the printed images 51 to 53, the correction amount based on the correction table is made to be 100% effective, so that the corrected density distributions 51B to 53B as illustrated in FIG. 22 are the same as those illustrated in FIG. 20. In each of the graphs of the density distributions 53A, 51B to 53B in FIG. 22, the waveform 50 of the correction table is also illustrated in a superimposed manner. On the other hand, for the printed images 54 and 55, as the density is higher (i.e., in the case of the printed image 55 rather than the printed image 54), the rate by which the correction amount based on the correction table is made to be effective is reduced. In each of the graphs of the density distributions 54B' and 55B' in FIG. 22, the waveform 50 of the correction table before the adjustment using the correction-amount adjustment table and the waveform 50' of the correction table after the adjustment are also illustrated in a superimposed manner. When the correction-amount adjustment table is used, the corrected density distributions 54B' and 55B' almost uniformly attain the value of "1" corresponding to the average value for all the heating elements, in contrast to the density distributions 54B and 55B illustrated in FIG. 20. As described above, when the correction-amount adjustment table is used, the density distribution can be properly corrected regardless of the density of the printed image.

The correction table, the correction-amount adjustment table, and information about the average printing density of the head 3 are stored in the storage unit 32 which is a non-volatile memory (EEPROM) attached inside the head 3 as correction data for the irregularities in the density. Since the irregularities in the density are primarily caused by the thermal head, the correction data is stored in the storage unit in the thermal head, not in the main body of the printer. This makes it possible to correct the irregularities in the density based on the correction data matching the thermal head, even if the user does not perform an operation to correct the density when the thermal head is replaced.

It should be noted that the correction table is generated for each head, but the correction-amount adjustment table is the same table for a plurality of heads as long as they are heads of the same specification. For this reason, the values of the correction-amount adjustment table are not measured and calculated during the adjustment of each head. However, when the thermal characteristics change due to improvement of the head and the like, the values of the correction-amount adjustment table are changed according to the characteristics of the new head. Therefore, the correction-amount adjustment table is also preferably stored in the storage unit 32 in the head instead of the storage unit in the main body of the printer. As a result, a preferable correction result for the irregularities in the density can be obtained without modifying the main body of the printer, when the head is replaced with one having an improved specification.

When the printer 1 prints an image, the printer 1 reads the correction data in the storage unit 32 of the head 3 and performs the correction processing of the irregularities in the density. At this time, the control unit 20 corrects the energy applied to each heating element 31 by an amount obtained by multiplying the correction amount of the energy for the heating element 31 obtained from the correction table by the correction rate (adjustment coefficient) obtained from the correction-amount adjustment table according to the density of the image to be newly printed. For each color of the inks to be transferred, the control unit 20 corrects the energy applied to each heating element 31 according to the density of the color of the image to be newly printed. Then, the control unit 20 controls the head driving unit 23 to cause each heating element 31 to generate heat according to the corrected applied energy, and sequentially transfer each ink of the ink ribbon 4 to the sheet.

The control unit 20 preferably determines the correction amount of the applied energy by also referring to the information about the average printing density which is the difference information between the density characteristic of the head serving as the reference (information about the reference density of the print) and the density characteristic of the head which is to be adjusted. More specifically, the control unit 20 preferably derives, from the correction table and the information about the average printing density, the correction amount for each heating element required to cause the heating element 31 to print with a density matching the reference density, and corrects the energy applied to each heating element 31 by an amount obtained by multiplying the correction amount by the correction rate according to the density of the image to be newly printed. This makes it possible to reduce not only the irregularities in the density in the width direction in a single head but also the density difference between a plurality of heads.

In the case of a printer which obtains a full color image by color mixture of YMC such as the printer 1, the energy applied to each heating element 31 is corrected by using the above correction table and correction-amount adjustment table for each color of YMC. The correction table and the correction-amount adjustment table explained above are illustrated with, for example, RGB values. However, since Y, M, and C are complementary colors of B, G, and R, respectively, making correction for each of the RGB colors is synonymous with making correction for each of the CMY colors.

FIG. 23 to FIG. 27 illustrate examples of correction amounts of irregularities in the density.

Figure 23:
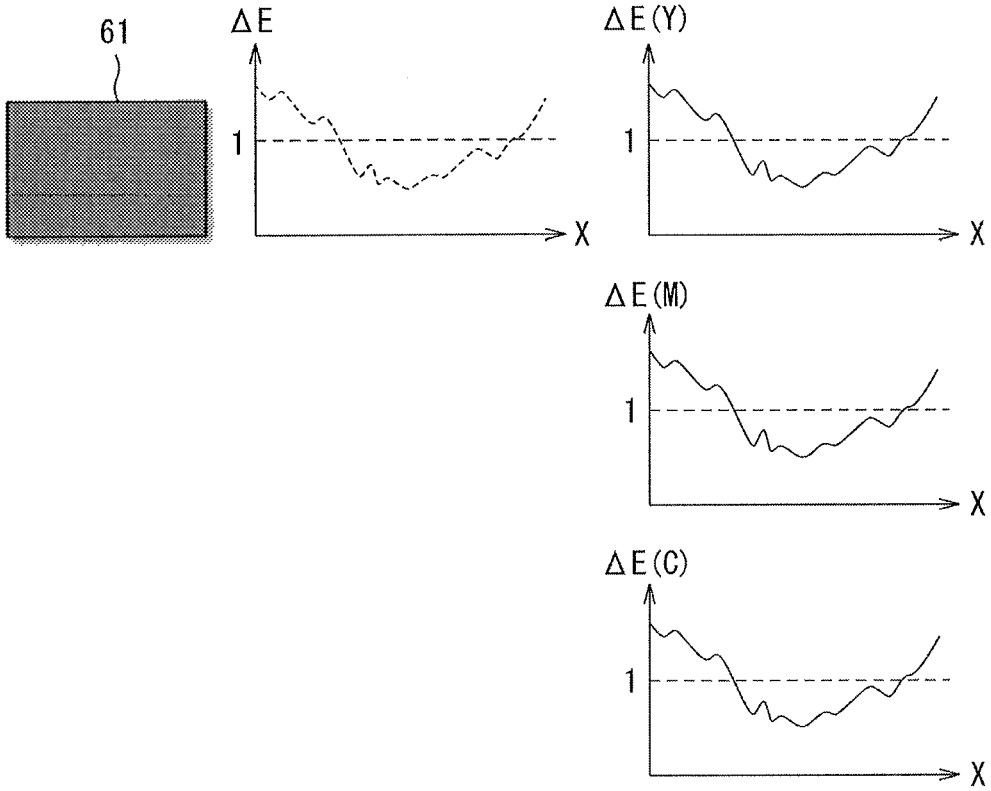
FIG. 23 illustrates an example of correction amounts of irregularities in the density.

FIG. 23 illustrates an example of correction amounts of irregularities in the density when the printed image is gray in halftone. The left side, the center, and the right side of FIG. 23 illustrate a printed image 61, a correction table ΔE for applied energy, and correction amounts ΔE(Y), ΔE(M), ΔE(C) of the applied energies for the colors of Y, M, and C, respectively. The horizontal axis X of each graph represents the position of each heating element 31 in the main scanning direction. The tone value for each of the YMC colors in the printed image 61 is assumed to be at a lower density side with respect to the tone value p at which the correction rate described in relation to FIG. 21 begins to decrease. In this case, since the correction rate obtained from the correction-amount adjustment table for each color is 100%, the energy applied to each heating element 31 is corrected by the same amount as the correction amount obtained from the correction table for each color.

Figure 24:
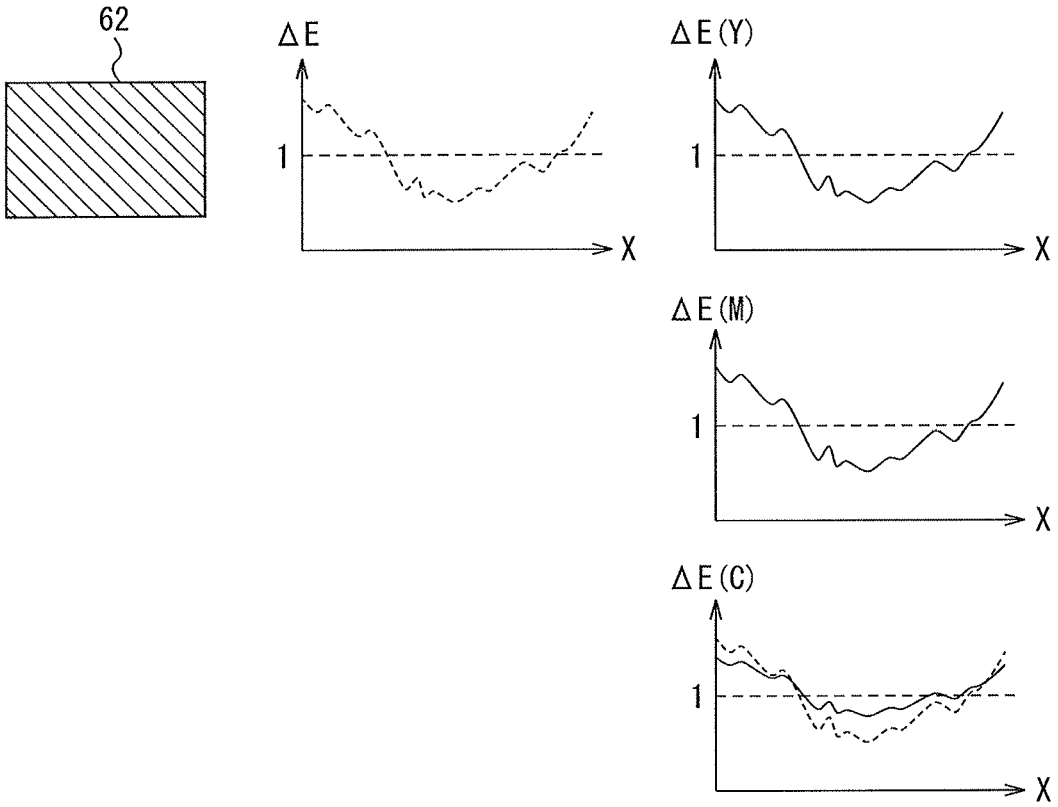
FIG. 24 illustrates an example of correction amounts of irregularities in the density.

FIG. 24 illustrates an example of correction amounts of irregularities in the density when the printed image is solid cyan. Like FIG. 23, the left side, the center, and the right side of FIG. 24 illustrate a printed image 62, a correction table ΔE for applied energy, and correction amounts ΔE(Y), ΔE(M), ΔE(C) of the applied energies for the colors of Y, M, and C, respectively. The horizontal axis X of each graph represents the position of each heating element 31 in the main scanning direction. The tone values of Y and M of the printed image 62 is 0, and the tone value of C is 255. In this case, the correction rates obtained from the correction-amount adjustment table are 100% for Y and M and about 50% for C. Therefore, for Y and M, the energy applied to each heating element 31 is corrected by the same amount as the correction amount obtained from the correction table. For C, the energy applied to each heating element 31 is corrected by about 50% of the correction amount obtained from the correction table. The broken-line graphs in FIG. 24 illustrate waveforms before the adjustment of the correction amount, and the solid-line graphs illustrate waveforms after the adjustment of the correction amount.

Figure 25:
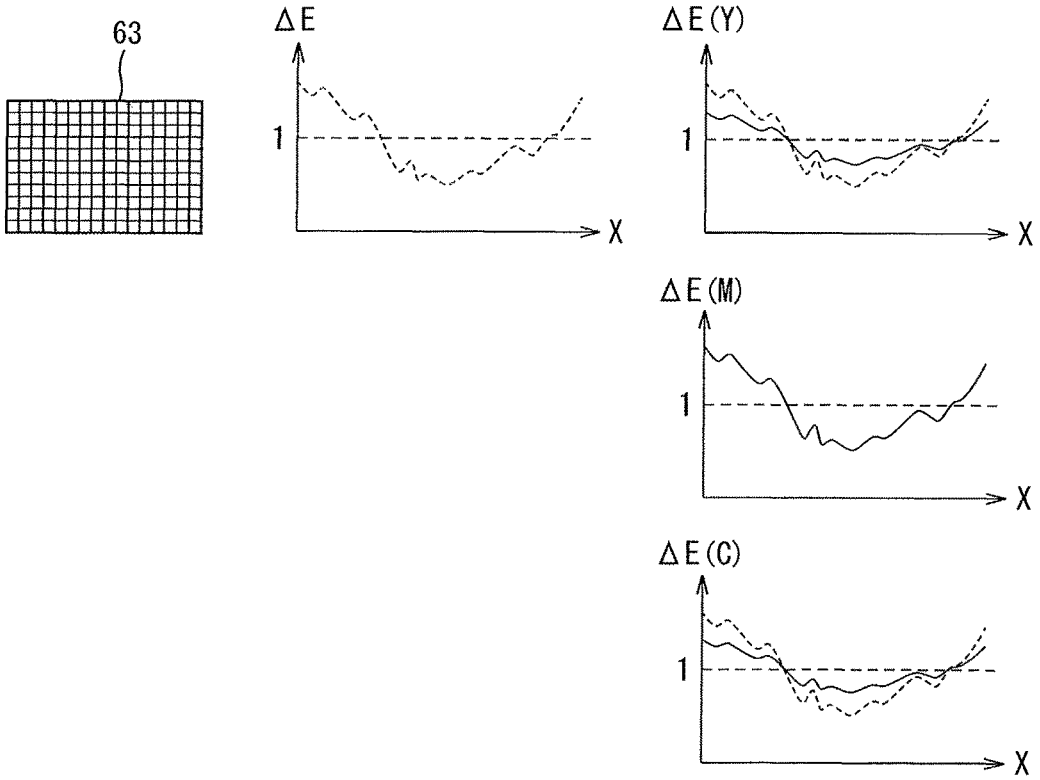
FIG. 25 illustrates an example of correction amounts of irregularities in the density.

FIG. 25 illustrates an example of correction amounts of irregularities in the density when the printed image is solid green. Like FIG. 23, the left side, the center, and the right side of FIG. 25 illustrate a printed image 63, a correction table ΔE for applied energy, and correction amounts ΔE(Y), ΔE(M), ΔE(C) of the applied energies for the colors of Y, M, and C, respectively. The horizontal axis X of each graph represents the position of each heating element 31 in the main scanning direction. The tone values of Y and C of the printed image 63 is 255, and the tone value of M is 0. In this case, the correction rates obtained from the correction-amount adjustment table are about 50% for Y and C and 100% for M. Therefore, for Y and C, the energy applied to each heating element 31 is corrected by about 50% of the correction amount obtained from the correction table. For M, the energy applied to each heating element 31 is corrected by the same amount as the correction amount obtained from the correction table. The broken-line graphs in FIG. 25 illustrate waveforms before the adjustment of the correction amount, and the solid-line graphs illustrate waveforms after the adjustment of the correction amount.

Figure 26:
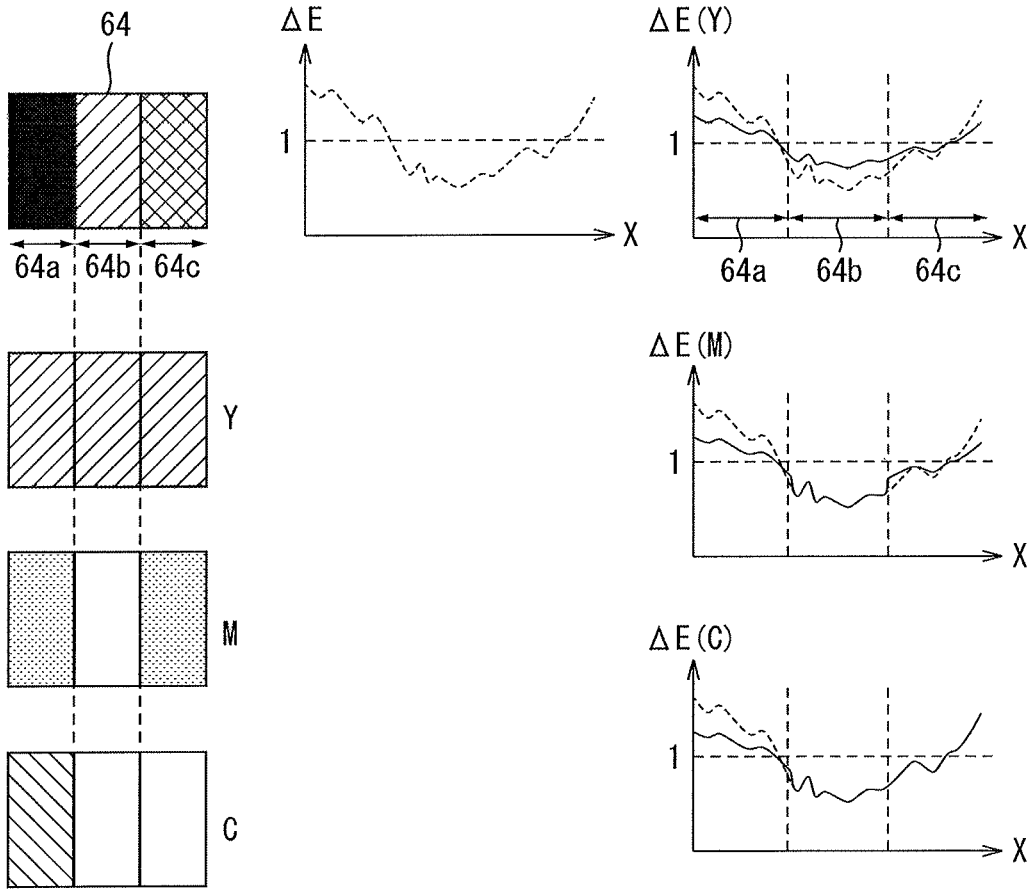
FIG. 26 illustrates an example of correction amounts of irregularities in the density.

FIG. 26 illustrates an example of correction amounts of irregularities in the density when the printed image is the flag of Belgium. The left side of FIG. 26 illustrates a printed image 64 and images (planes) of the YMC colors for constituting the printed image 64. The Belgian flag consists of black, yellow, and red areas in this order from the left side. Therefore, in the Y plane, the entire surface is yellow with a tone value 255. In the M plane, a left side 64*a* and a right side 64*c* are magenta with a tone value 255, and a center 64*b* has a tone value 0. In the C plane, only the left side 64*a* is cyan with a tone value 255, and the center 64*b* and the right side 64*c* have a tone value 0. The center and the right side of FIG. 26 illustrate a correction table ΔE for applied energy, and correction amounts ΔE(Y), ΔE(M), ΔE(C) of the applied energies for the colors of Y, M, and C, respectively. It is assumed that the horizontal direction of the printed image 64 illustrated in FIG. 26 is the main scanning direction, and the horizontal axis X of each graph represents the position of each heating element 31 in the main scanning direction. The broken-line graphs in FIG. 26 illustrate waveforms before the adjustment of the correction amount, and the solid-line graphs illustrate waveforms after the adjustment of the correction amount.

In the Y plane, the correction rate obtained from the correction-amount adjustment table is about 50% on the whole surface, so that the energies applied to all the heating elements 31 are corrected by about 50% of the correction amount obtained from the correction table. In the M plane, the correction rate obtained from the correction-amount adjustment table is about 50% at the left side 64*a* and the right side 64*c*, and 100% in the center 64*b*. Therefore, for the heating elements 31 corresponding to the left side 64*a* and the right side 64*c*, the energy applied to each heating element 31 is corrected by about 50% of the correction amount obtained from the correction table. For the heating elements 31 corresponding to the center 64*b*, the energy applied to each heating element 31 is corrected by the same amount as the correction amount obtained from the correction table. In the C plane, the correction rate obtained from the correction-amount adjustment table is about 50% at the left side 64*a*, and 100% in the center 64*b* and at the right side 64*c*. Therefore, for the heating elements 31 corresponding to the left side 64*a*, the energy applied to each heating element 31 is corrected by about 50% of the correction amount obtained from the correction table. For the heating elements 31 corresponding to the center 64*b* and the right side 64*c*, the energy applied to each heating element 31 is corrected by the same amount as the correction amount obtained from the correction table.

Figure 27:
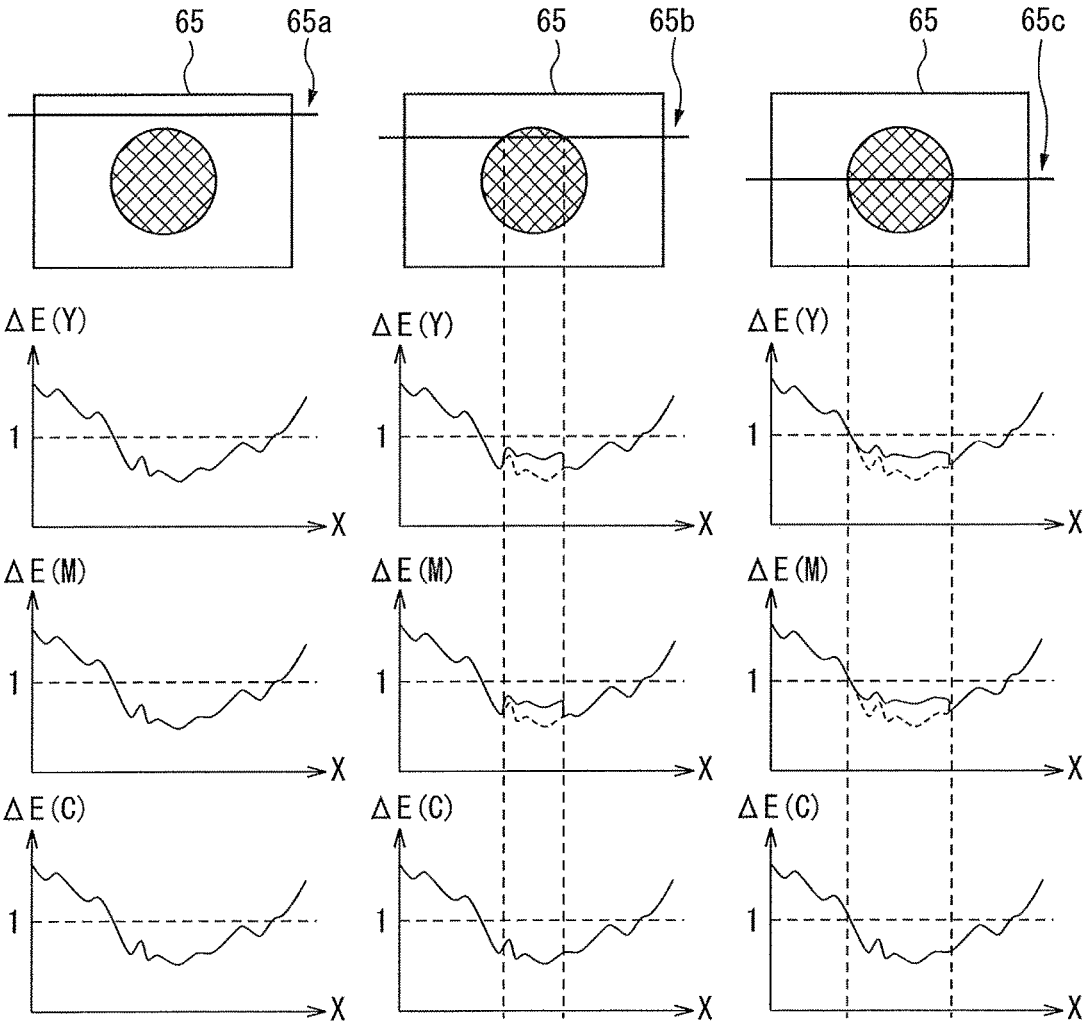
FIG. 27 illustrates an example of correction amounts of irregularities in the density.

FIG. 27 illustrates an example of correction amounts of irregularities in the density when the printed image is the flag of Japan. It is assumed that, in FIG. 27, the horizontal direction of the printed image 65 is the main scanning direction, and the vertical direction thereof is the sub-scanning direction. The left side, the center, and the right side of FIG. 27 illustrate correction amounts ΔE(Y), ΔE(M), ΔE(C) of the colors of Y, M, C, at the lines 65*a* to 65*c*, respectively, of which positions in the sub-scanning direction are different. The correction table is assumed to be the same as those illustrated in FIG. 23 to FIG. 26. The broken-line graphs in FIG. 27 illustrate waveforms before the adjustment of the correction amount, and the solid-line graphs illustrate waveforms after the adjustment of the correction amount.

On the line 65*a*, the entire range of the main scanning direction is white (all of the tone values of YMC are zero). Therefore, since the correction rate for each color is 100%, the applied energy is corrected for each color by the same amount as the correction amount obtained from the correction table.

On the line 65*b*, the center portion of the main scanning direction is red (the tone values of Y and M are 255, and the tone value of C is 0), and the other portion is white (all of the tone values of YMC are zero). Therefore, for Y and M, the correction rate for the center portion is about 50%, and the correction rate for the other portion is 100%. Thus, the energies applied to the heating elements 31 corresponding to the center portion are corrected by about 50% of the correction amount of the correction table, and the energies applied to the other heating elements 31 are corrected by the same amount as the correction amount of the correction table. For C, since the correction rate for the whole range is 100%, the applied energy is corrected by the same amount as the correction amount of the correction table.

On the line 65*c*, the correction rate for each color is the same as those for the line 65*b*, since the only difference between the lines 65*b* and 65*c* is the width of the red portion.

As explained above, the printer 1 uses the correction table and the correction-amount adjustment table to correct the energy applied to each heating element 31 according to the density of the image to be newly printed. The correction table represents the correction amount of the energy applied to each heating element 31, the correction amount being generated from the density distribution of the test image printed based on the image data of a single tone. The correction-amount adjustment table indicates how much the correction amount based on the correction table is made to be effective according to the density of the image to be printed. As a result, even if there are irregularities in the density caused by the thermal head, it is relatively easy to obtain a uniform print result without any irregularities in the density.

In the case of a printer capable of switching between a plurality of print speeds, the storage unit 32 of the head 3 preferably stores a plurality of correction tables generated for the respective print speeds. According to the print speed, each heating element 31 has a different energization time, but the energy required for producing color is the same regardless of the print speed. When the print speed is fast, the peak temperature of the head 3 is relatively high and a large amount of heat is instantaneously applied. On the other hand, when the printing speed is slow, the peak temperature of head 3 is relatively low and the same amount of heat is applied over a longer period of time. Since the correction amount of applied energy also changes according to the peak temperature of the head 3, the correction table of correction amount suitable for the print speed is preferably stored in the storage unit 32. Since the correction amount of irregularities in the density is determined using both the correction table and the correction-amount adjustment table, it is preferable to store correction-amount adjustment tables for different print speeds. In this case, at the time of printing, the control unit 20 refers to the correction table and the correction-amount adjustment table corresponding to the print speed of the head 3, so that the control unit 20 corrects the energy applied to each heating element 31 with the correction amount matching the print speed.

Figure 28:
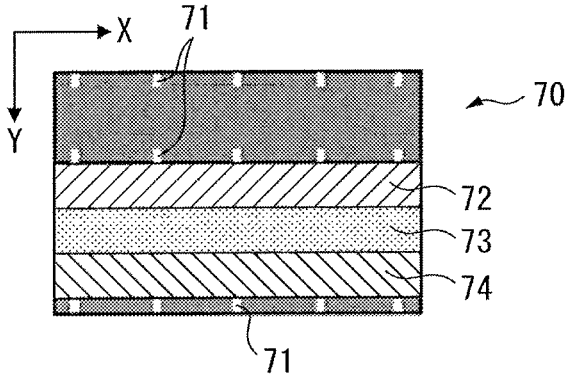
FIG. 28 illustrates another example of the test image.

FIG. 28 illustrates another example of the test image. The test image 70 illustrated in FIG. 28 is a gray image of a single tone provided with a plurality of markers 71 indicating the positions of the heating elements 31 and single-color bands 72 to 74 of Y, M, and C. At the time of generation of correction data for irregularities in the density described with FIG. 4 and FIG. 5, such a test image 70 having YMC single-color bands may be used instead of the test image 40 of FIG. 3. Y dye of the ink ribbon contains M component and C component, and M dye and C dye similarly contain other color components. For this reason, when evaluating the unevenness of application from the RGB components of the test image 40 having single-tone gray during the processing for reducing the adverse effect of unevenness of application, an application-uneven component may appear in colors other than the ribbon panel (one ink area on the ink ribbon) that caused the problem. However, when the test image 70 having the YMC single-color bands is used to print each color without mixing, the irregularities in the density occurring only in a specific ribbon panel can be detected more accurately.

The invention claimed is:

1. A thermal transfer printer comprising:

a thermal head including a plurality of heating elements and causing the heating elements to generate heat and transfer ink onto a sheet to print an image on the sheet;

a storage unit for storing a first correspondence between a heating element in the thermal head and a correction amount of energy applied to the heating element, and a second correspondence between a tone value of an image to be printed and an adjustment coefficient of the correction amount, the first correspondence being generated from a density distribution of a test image printed based on image data of a single tone, wherein the adjustment coefficient is reduced as a printing density indicated by the tone value is higher; and a control unit for correcting energy applied to each of the heating elements by an amount obtained by multiplying the correction amount for the heating element obtained from the first correspondence by the adjustment coefficient obtained from the second correspondence according to a tone value of an image to be newly printed.

2. The thermal transfer printer according to claim 1, wherein the storage unit is a non-volatile memory attached to the thermal head.

3. The thermal transfer printer according to claim 1, wherein the storage unit further stores information about a reference density of printing with the thermal head, and the control unit corrects the energy by an amount obtained by multiplying the correction amount for the heating element obtained from the information about the reference density and the first correspondence by the adjustment coefficient according to a density of an image to be newly printed, the correction amount being required to cause a density of printing with each heating element to match the reference density.

4. The thermal transfer printer according to claim 1, wherein the thermal head can print an image at one of a plurality of print speeds, the storage unit stores the first correspondence and the second correspondence for each of the print speeds, and the control unit corrects the energy by referring to the first correspondence and the second correspondence according to a print speed of the thermal head.

5. The thermal transfer printer according to claim 1, wherein the storage unit stores a correction table for each color comprising a first correspondence between a heating element in the thermal head and a correction amount of energy applied to the heating element for each of a plurality of print speeds, and a correction-amount adjustment table for each color comprising a second correspondence between a tone value of an image to be printed and an adjustment coefficient of the correction amount for each of the plurality of print speeds, the first correspondence being generated from a density distribution of a test image printed based on image data of a single tone for each of the plurality of print speeds, wherein the adjustment coefficient is reduced as a printing density indicated by the tone value is higher; and the control unit corrects energy applied to each of the heating elements for each color at a selected print speed by an amount obtained by multiplying the correction amount for the heating element obtained from the first correspondence at the selected print speed by the adjustment coefficient obtained from the second correspondence at the selected print speed according to a tone value of an image to be newly printed.

6. A method of printing an image using a thermal transfer printer, comprising the steps of:

generating a first correspondence between each of a plurality of heating elements in a thermal head and a correction amount of energy applied to the heating element, from a density distribution of a test image printed based on image data of a single tone;

correcting energy applied to each of the heating elements by an amount obtained by multiplying the correction amount for the heating element obtained from the first correspondence by an adjustment coefficient obtained from a second correspondence between a tone value of an image to be printed and the adjustment coefficient of the correction amount according to a tone value of an image to be newly printed, wherein the adjustment coefficient is reduced as a printing density indicated by the tone value is higher; and transferring ink onto a sheet by causing the plurality of heating elements to generate heat with the corrected energy.

7. The method according to claim 6, wherein the step of generating includes the steps of:

printing the test image with the thermal head;

scanning the printed test image;

calculating an average density distribution on the scanned test image; and determining the correction amount for each of the plurality of heating elements on the basis of the average density distribution.

8. The method according to claim 7, wherein in the step of calculating, the average density distribution is calculated by deriving an average density of the scanned test image in a sub-scanning direction of printing for a position corresponding to each of the heating elements arranged in a main scanning direction of printing and further deriving a moving average of the average density in the main scanning direction.

9. The method according to claim 7, wherein in the step of printing, inks of a plurality of colors are sequentially transferred onto a sheet, and thereby a test image generated so as to have a mixed color of the inks of all the colors is printed on the sheet, in the step of scanning, the printed test image is scanned as a color image, and in the step of calculating, the average density distribution is calculated by deriving a density distribution of the scanned test image of each component of RGB of the color image and further averaging a waveform of the density distribution of each component by reducing a weighting for a variation portion appearing only in one of the RGB colors in the waveform of the density distribution of the component thus derived.

10. The method according to claim 6, wherein the step of generating includes generating a correction table for each color for each of a plurality of print speeds comprising a first correspondence between each of a plurality of heating elements in a thermal head and a correction amount of energy applied to the heating element, from a density distribution of a test image printed based on image data of a single tone; and the step of correcting energy comprises correcting energy applied to each of the heating elements at a selected print speed by an amount obtained by multiplying the correction amount for the heating element obtained from the first correspondence at the selected print speed by an adjustment coefficient obtained from a second correspondence at the selected print speed between a tone value of an image to be printed and the adjustment coefficient of the correction amount according to a tone value of an image to be newly printed, wherein the adjustment coefficient is reduced as a printing density indicated by the tone value is higher.

11. A method of printing an image using a thermal transfer printer, comprising the steps of:

generating a first correspondence between each of a plurality of heating elements in a thermal head and a correction amount of energy applied to the heating element, from a density distribution of a test image printed based on image data of a single tone;

correcting energy applied to each of the heating elements by an amount obtained by multiplying the correction amount for the heating element obtained from the first correspondence by an adjustment coefficient obtained from a second correspondence between a density of an image to be printed and the adjustment coefficient of the correction amount according to a density of an image to be newly printed; and transferring ink onto a sheet by causing the plurality of heating elements to generate heat with the corrected energy;

wherein the step of generating includes the steps of:

printing the test image with the thermal head;

scanning the printed test image;

calculating an average density distribution on the scanned test image, wherein the average density distribution is calculated by deriving an average density of the scanned test image in a sub-scanning direction of printing for a position corresponding to each of the heating elements arranged in a main scanning direction of printing and further deriving a moving average of the average density in the main scanning direction; and determining the correction amount for each of the plurality of heating elements on the basis of the average density distribution.

* * * * *